US010706779B2

(12) United States Patent
Furihata et al.

(10) Patent No.: US 10,706,779 B2
(45) Date of Patent: Jul. 7, 2020

(54) DEVICE AND METHOD FOR IMAGE DATA PROCESSING

(71) Applicant: SYNAPTICS INCORPORATED, San Jose, CA (US)

(72) Inventors: Hirobumi Furihata, Tokyo (JP); Damien Berget, Sunnyvale, CA (US); Takashi Nose, Tokyo (JP); Joseph Kurth Reynolds, San Jose, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 74 days.

(21) Appl. No.: 15/594,203

(22) Filed: May 12, 2017

(65) Prior Publication Data

US 2018/0240404 A1 Aug. 23, 2018

Related U.S. Application Data

(60) Provisional application No. 62/462,586, filed on Feb. 23, 2017.

(51) Int. Cl.
*G09G 3/3258* (2016.01)
*G09G 3/3275* (2016.01)
(Continued)

(52) U.S. Cl.
CPC ..... *G09G 3/3258* (2013.01); *G09G 3/2011* (2013.01); *G09G 3/3275* (2013.01);
(Continued)

(58) Field of Classification Search
CPC .. G09G 3/3258; G09G 3/3291; G09G 3/2011; G09G 5/395; G09G 2310/027;
(Continued)

(56) References Cited

U.S. PATENT DOCUMENTS 7,012,626 B2 3/2006 Shingai et al.
7,623,108 B2 11/2009 Jo et al.
(Continued)

FOREIGN PATENT DOCUMENTS

JP 2010237528 A 10/2010

*Primary Examiner* — David Tung
(74) *Attorney, Agent, or Firm* — Patterson + Sheridan, LLP

(57) ABSTRACT

A display driver for driving a display panel includes a voltage data generator circuit calculating a voltage data value from an input grayscale value and a driver circuitry driving the display panel in response to the voltage data value. The voltage data generator circuit includes a basic control point data storage circuit storing therein basic control point data specifying a basic correspondence relationship between the input grayscale value and the voltage data value, a correction data memory storing correction data for each of the pixel circuits, a control point calculation circuit and a data correction circuit. When the voltage data value is calculated for a specific pixel circuit, the control point calculation circuit generates control point data associated with the specific pixel circuit by correcting the basic control point data on the basis of the correction data associated with the specific pixel circuit, and The data correction circuit calculates the voltage data value from the input grayscale value on the basis of the correspondence relationship specified by the control point data associated with the control point data.

20 Claims, 23 Drawing Sheets

(51) Int. Cl.

| | |
|---|---|
| ***G09G 3/20*** | (2006.01) |
| ***G09G 5/395*** | (2006.01) |
| ***G09G 3/3291*** | (2016.01) |

(52) U.S. Cl.
CPC ..... *G09G 3/3291* (2013.01); *G09G 5/395* (2013.01); *G09G 2300/0439* (2013.01); *G09G 2310/027* (2013.01); *G09G 2320/0271* (2013.01); *G09G 2320/0285* (2013.01); *G09G 2320/0626* (2013.01); *G09G 2330/028* (2013.01); *G09G 2340/02* (2013.01); *G09G 2350/00* (2013.01)

(58) Field of Classification Search
CPC ... G09G 2320/0285; G09G 2320/0626; G09G 2320/0271; G09G 2340/02; G09G 2350/00; G09G 2330/028; G09G 2300/0439
See application file for complete search history.

(56) References Cited

U.S. PATENT DOCUMENTS

| | | | | |
|---|---|---|---|---|
| 7,859,492 | B2 | 12/2010 | Kohno | |
| 8,022,908 | B2 | 9/2011 | Mizukoshi et al. | |
| 8,149,190 | B2 | 4/2012 | Mizukoshi et al. | |
| 2007/0153021 | A1* | 7/2007 | Umeda | G09G 3/2007 345/600 |
| 2010/0134468 | A1* | 6/2010 | Ogura | G09G 3/3291 345/211 |
| 2011/0148942 | A1* | 6/2011 | Furihata | G09G 5/003 345/690 |
| 2012/0154453 | A1* | 6/2012 | Yamashita | G09G 3/3225 345/690 |
| 2015/0228215 | A1* | 8/2015 | Nose | G06T 11/001 345/590 |
| 2015/0356899 | A1* | 12/2015 | Yamanaka | G09G 3/3225 345/690 |
| 2016/0035293 | A1* | 2/2016 | Furihata | G09G 3/36 345/694 |

* cited by examiner $AX_0=X_{CP}(2k)$
$AX_0=X_{CP}(2k+1)$
$AX_0=X_{CP}(2k+2)$
$YX_0=Y_{CP}(2k)$
$BY_0=Y_{CP}(2k+1)$
$CY_0=Y_{CP}(2k+2)$

DEVICE AND METHOD FOR IMAGE DATA PROCESSING

TECHNICAL FIELD

The present invention relates to a display driver, display device and method of driving a display panel, more particularly, to image data processing in driving a display panel.

BACKGROUND ART

In a display driver which drives a display panel, such as an OLED (organic light emitting diode) display panel and a liquid crystal display panel, voltage data corresponding to drive voltages to be supplied to the display panel may be generated from grayscale values of respective subpixels of respective pixels described in image data.

FIG. 1 is a graph illustrating one exemplary correspondence relationship between the grayscale value of a subpixel described in an image data and the value of a voltage data. In FIG. 1, the graph of the correspondence relationship between the grayscale value and the value of the voltage data is illustrated with an assumption that the voltage proportional to the value of the voltage data is programmed to each subpixel of each pixel of an OLED display panel, in relation to the processing of the image data in driving the OLED display panel. When the grayscale value of a certain subpixel is "0", for example, the value of the voltage data associated with the subpixel of interest is set to "1023"; in this case, the subpixel of interest is programmed with a drive voltage corresponding to the value "1023" of the voltage data, that is, a drive voltage of 5V in the example illustrated in FIG. 1. It should be noted that the brightness is increased as the drive voltage is lowered when the OLED display panel is driven with voltage programming. It should be noted that the correspondence relationship between the grayscale value of a subpixel described in an image data and the value of the voltage data is also dependent on the type of display panel. For example, in driving a liquid crystal display panel, the correspondence relationship between the grayscale value of a subpixel and the value of a voltage data is determined in general so that the drive voltage is generated so as to increase the difference between the drive voltage and the voltage on the common electrode (that is, the common level) as the grayscale value of the subpixel is increased.

A correction may be performed on an image data to improve the image quality of the image displayed on a display panel. In a display device including an OLED display panel, for example, there exist variations in the properties of OLED light emitting elements included in respective subpixels (respective pixel circuits) and the variations in the properties may cause a deterioration of the image quality, including display mura. In such a case, the display mura can be suppressed by preparing correction data for respective subpixels of respective pixels of the OLED display panel and correcting the image data corresponding to the respective pixel circuits in response to the prepared correction data.

FIG. 2 illustrates one example of the circuit configuration in which corrected image data are generated by correcting input image data and voltage data are generated from the corrected image data. In the configuration illustrated in FIG. 2, a correction circuit 101 generates corrected image data by correcting input image data and a voltage data generator circuit 102 generates voltage data from the corrected image data. In FIG. 2, the circuit configuration is illustrated with an assumption that the input image data and the corrected image data both describe the grayscale value of each subpixel with eight bits.

One issue of the circuit configuration illustrated in FIG. 2 is that an appropriate correction cannot be achieved in some cases when the grayscale value of an input image data is close to the allowed maximum grayscale value or the allowed minimum grayscale value. FIG. 3 is an illustration illustrating this issue. With respect to a correction circuit 101 configured to perform a correction which increases the grayscale value as illustrated in FIG. 3, the grayscale value of the corrected image data may be saturated at the allowed maximum grayscale value, when an input image data having a grayscale value close to the allowed maximum grayscale value is supplied to the correction circuit 101. In this case, the value of the voltage data is also saturated and this may cause deterioration of the image quality. A similar problem may occur with respect to a correction circuit 101 configured to perform a correction which decreases the grayscale value, when an input image data having a grayscale value close to the allowed minimum grayscale value is supplied to the correction circuit 101.

This problem may be avoided by increasing the bit width of the corrected image data supplied to the voltage data generator circuit 102; however, the increase in the bit width of the corrected image data may increase the circuit size of the voltage data generator circuit 102.

Another issue of the circuit configuration illustrated in FIG. 2 is that direct correction of drive voltages supplied to the display panel cannot be achieved. Discussed below is the case when the voltage offset of a subpixel of a display panel is to be cancelled through correction in a display driver configured to generate drive voltages proportional to the values of voltage data. In this case, it is most preferable that the voltage data is corrected so as to cancel the voltage offset; however, the circuit configuration illustrated in FIG. 2 only allows indirectly correcting the value of the voltage data through correcting the input image data. The value of the voltage data obtained as a result of the correction on the image data is not equivalent to the value obtained by directly correcting the voltage data. This may cause a deterioration of the image quality.

As discussed above, there exists a technical need for suppressing the image quality deterioration when image data correction is performed in a display driver configured to generate voltage data corresponding to drive voltages to be supplied to a display panel from the grayscale values of respective subpixels of respective pixels described in image data.

It should be noted that Japanese Patent Application Publication No. 2005-17420 A discloses a technique related to a display device including an OLED display panel, in which correction data are stored for respective pixels in a memory, and drive voltages determined based on data obtained by adding the correction data stored in the memory to video signal data are applied to the drive transistors of the respective pixels.

Japanese Patent Application Nos. 2006-349966 A, 2007-279290 A, 2009-223070 A disclose display devices configured to perform gamma corrections on R, G and B signals, multiply multiplication correction values with multipliers and add offset correction values with adders.

Japanese Patent Application No. 2005-250121 A discloses a drive circuit for driving an electro-optical device, which stores in correction data storage means block correction data respectively associated with a plurality of blocks obtained by dividing a pixel array area and corrects the control data controlling the emitted light brightness on the basis of the block correction data.

Japanese Patent Application Publication No. 2010-237528 A discloses a technique for compensating brightness variations of light emitting elements by correcting the image signal in response to the time-dependent deterioration properties of the light emitting elements. In the technique disclosed in this publication, the value of estimated emitted light luminance of each light emitting element is calculated and a correction value is determined for each light emitting element to reduce the difference between the maximum and minimum values of the estimated emitted light luminance.

SUMMARY OF INVENTION

Therefore, one objective of the present disclosure is to suppress image quality deterioration in correcting image data in a display driver configured to generate voltage data corresponding to drive voltages to be supplied to a display panel from the grayscale values of the respective subpixels of the respective pixels described in image data. Other objectives and new features of the present disclosure would be understood by a person skilled in the art from the following description.

Provided in one embodiment is a display driver for driving a display panel including a plurality of pixel circuits. The display driver includes: a voltage data generator circuit which calculates a voltage data value from an input grayscale value; and a driver circuitry which drives the display panel in response to the voltage data value. The voltage data generator circuit includes: a basic control point data storage circuit storing basic control point data which specifies a basic correspondence relationship between the input grayscale value and the voltage data value; a correction data memory holding a correction data for each of the plurality of pixel circuits; a control point calculation circuit; and a data correction circuit. When a voltage data value is calculated with respect to a specific pixel circuit of the plurality of pixel circuits, the control point calculation circuit generates control point data associated with the specific pixel circuit by correcting the basic control point data based on a correction data associated with the specific pixel circuit. When calculating the voltage data value with respect to the specific pixel circuit, the data correction circuit calculates the voltage data value from the input grayscale value based on a correspondence relationship specified by the control point data associated with the specific pixel circuit.

The display driver thus configured is preferably used in a display device.

Provided in another embodiment is a driving method for driving a display panel including a plurality of pixel circuits. The driving method includes: calculating a voltage data value from an input grayscale value; and driving a display panel in response to the voltage data value. The step of calculating the voltage data value includes: preparing a basic control point data defining a basic correspondence relationship between the input grayscale value and the voltage data value; preparing a correction data for each of the plurality of pixel circuits; when a voltage data value with respect to a specific pixel circuit of the plurality of pixel circuits, generating a control point data corresponding to the specific pixel circuit by correcting the basic control point data based on the correction data associated with the specific pixel circuit; and when the voltage data value is calculated with respect to the specific pixel circuit, calculating the voltage data value from the input grayscale value based on a correspondence relationship specified by the control point data associated with the specific pixel circuit.

The present invention effectively suppresses image quality deterioration in correcting image data in a display driver configured to generate voltage data corresponding to drive voltages to be supplied to a display panel from the grayscale values of the respective subpixels of the respective pixels described in image data.

BRIEF DESCRIPTION OF THE DRAWINGS

The above and other advantages and features of the present invention will be more apparent from the following description taken in conjunction with the accompanied drawings, in which.

DESCRIPTION OF PREFERRED EMBODIMENTS

In the following, a description is given of embodiments of the present disclosure with reference to the attached drawings.

First Embodiment

Figure 1:
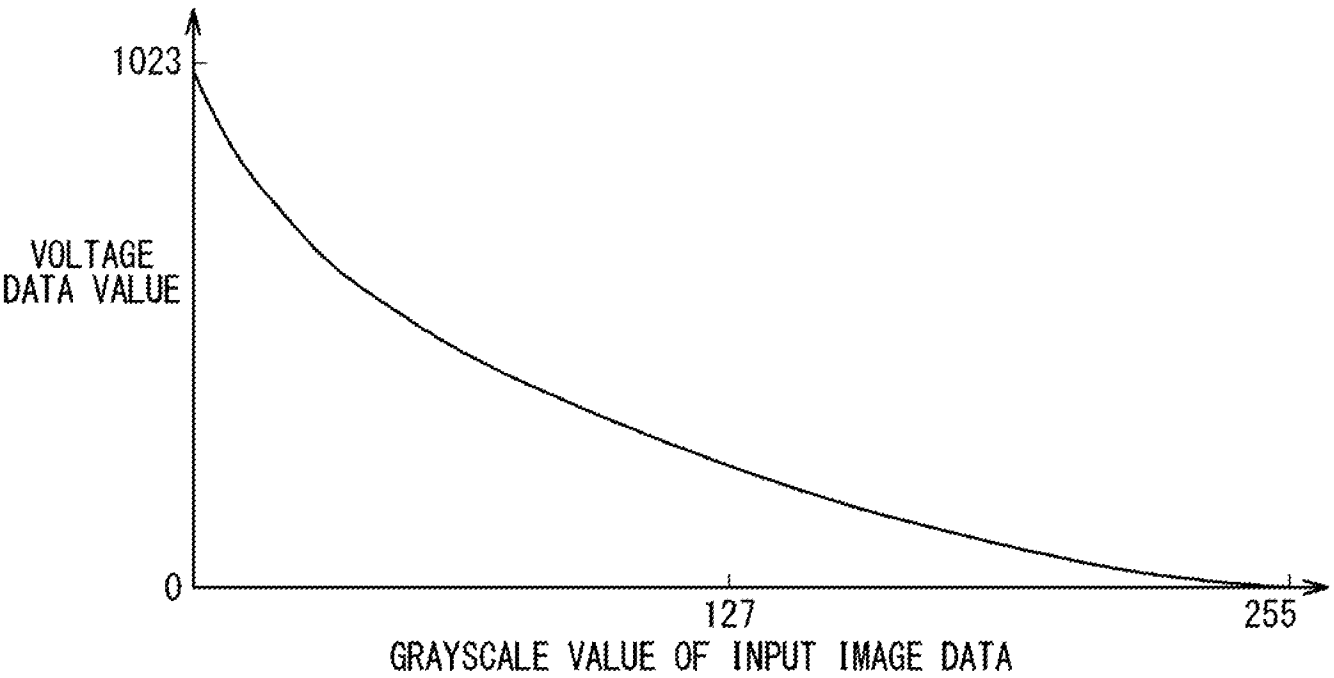
FIG. 1 is a graph illustrating one example of the correspondence relationship between the grayscale value of a subpixel described in an image data and the value of a voltage data.
Figure 2:
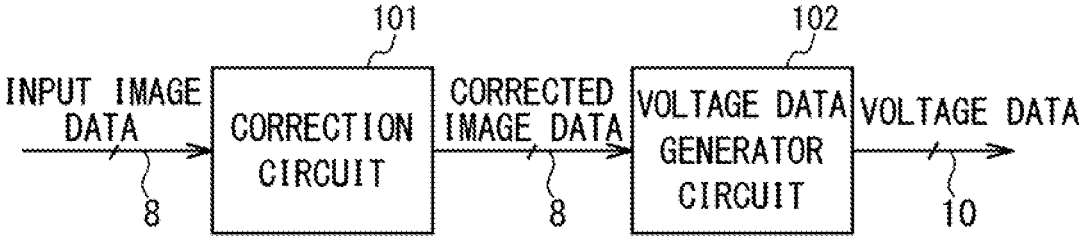
FIG. 2 illustrates one example of the circuit configuration which generates a corrected image data by correcting an input image data and generates a voltage data from the corrected image data.
Figure 4A:
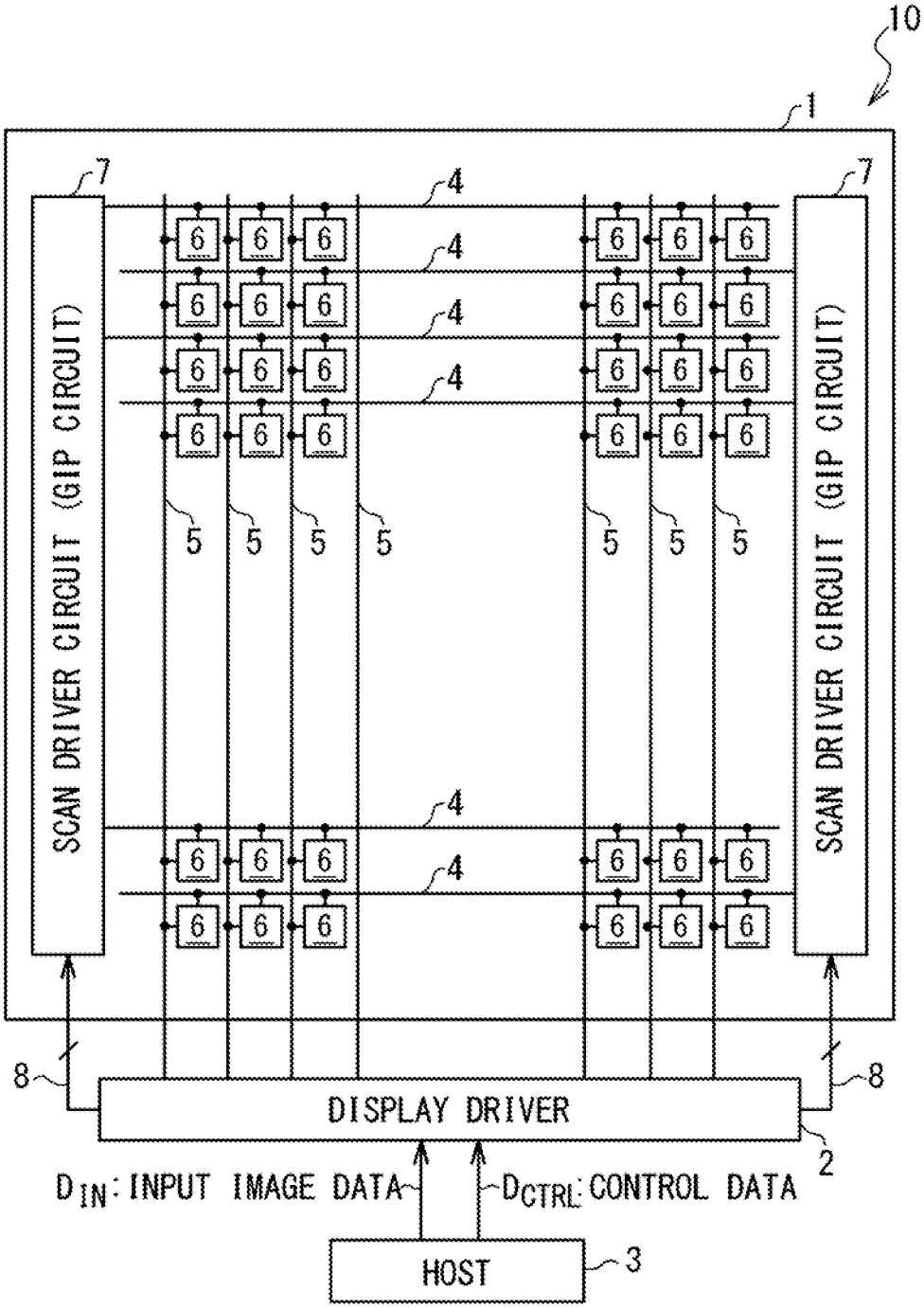
FIG. 4A is a block diagram illustrating the configuration of a display device in a first embodiment.

FIG. 4A is a block diagram illustrating the configuration of a display device 10 in a first embodiment. The display device 10 of FIG. 1 includes a display panel 1 and a display driver 2. An OLED (Organic Light Emitting Diode) display panel or a liquid crystal display panel may be used as the display panel 1, for example. The display driver 2 drives the display panel 1 in response to input image data $D_{IN}$ and control data $D_{CTRL}$ which are received from a host 3. The input image data $D_{IN}$ describe the grayscale values of the respective subpixels (R subpixels, G subpixels and B subpixels) of the respective pixels of images to be displayed. In the present embodiment, the input image data $D_{IN}$ describe the grayscale value of each subpixel of each pixel with eight bits. The control data $D_{CTRL}$ include commands and parameters for controlling the display driver 2.

The display panel 1 includes scan lines 4, data lines 5, pixel circuits 6 and scan driver circuits 7.

Each of the pixel circuits 6 is disposed at an intersection of a scan line 4 and a data line 5 and configured to display a selected one of the red, green and blue colors. The pixel circuits 6 displaying the red color are used as R subpixels. Similarly, the pixel circuits 6 displaying the green color are used as G subpixels, and the pixel circuits 6 displaying the blue color are used as B subpixels. When an OLED display panel is used as the display panel 1, in one embodiment, the pixel circuits 6 displaying the red color may include an OLED element emitting red colored light, the pixel circuits 6 displaying the green color may include an OLED element emitting green colored light, and the pixel circuits 6 displaying the blue color may include an OLED element emitting blue colored light. Alternatively, each pixel circuit 6 may include an OLED element emitting white-colored light and the color displayed by each pixel circuit 6 (red, green or blue) may be set with a color filter. It should be noted that, when an OLED display panel is used as the display panel 1, other signal lines for operating the light emitting elements within the respective pixel circuits 6, such as emission lines used for controlling light emission of the light emitting elements of the respective pixel circuits 6, may be disposed.

The scan driver circuits 7 drive the scan lines 4 in response to scan control signals 8 received from the display driver 2. In the present embodiment, a pair of scan driver circuits 7 are provided; one of the scan driver circuits 7 drives the even-numbered scan lines 4 and the other drives the odd-numbered scan lines 4. In the present embodiment, the scan driver circuits 7 are integrated in the display panel 1 with a GIP (gate-in-panel) technology. The scan driver circuits 7 thus configured may be referred to as GIP circuits.

Figure 4B:
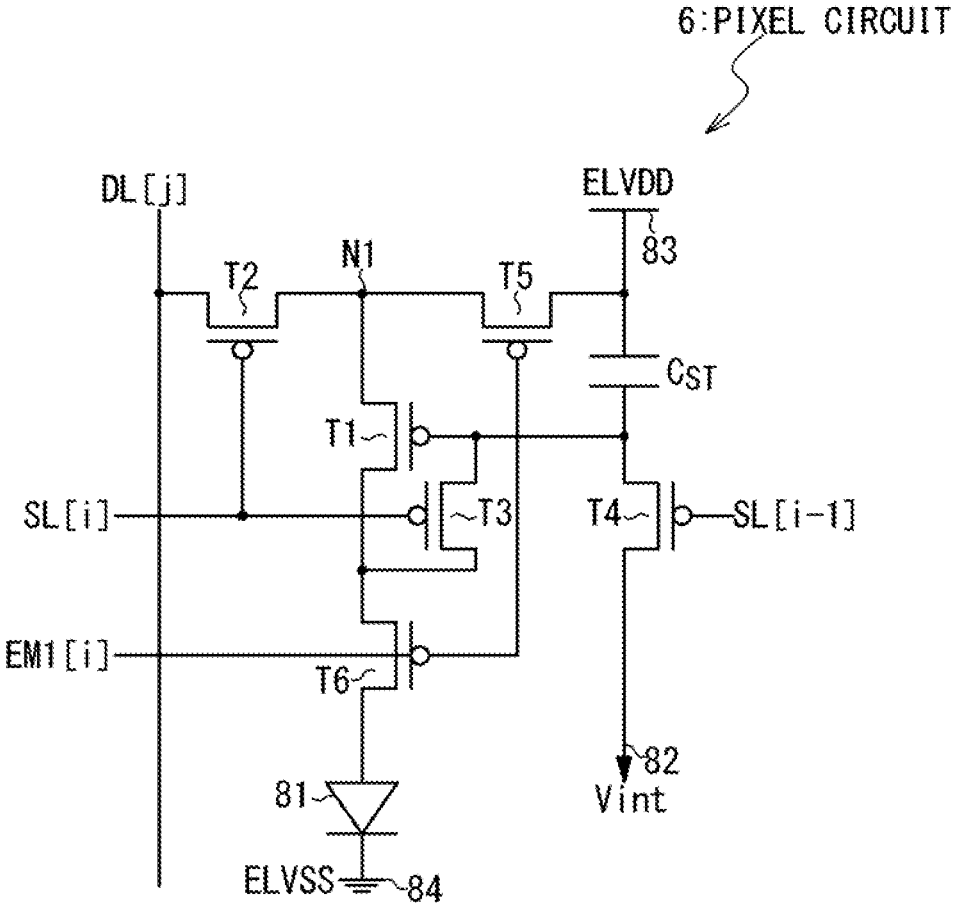
FIG. 4B is a block diagram illustrating an example of the configuration of a pixel circuit.

FIG. 4B illustrates an example of the configuration of the pixel circuit 6 when an OLED display panel is used as the display panel 1. In this figure, the symbol SL[i] denotes the scan line 4 which is activated in a horizontal sync period in which data voltages are written into the pixel circuits 6 positioned in the $i^{th}$ row. Similarly, the symbol SL[i−1] denotes the scan line 4 which is activated in a horizontal sync period in which data voltages are written into the pixel circuits 6 positioned in the $(i-1)^{th}$ row. In the meantime, the symbol EM[i] denotes an emission line which is activated to allow the OLED elements of the pixel circuits 6 positioned in the $i^{th}$ row to emit light, and the symbol DL[j] denotes the data line 5 connected to the pixel circuits 6 positioned in the $j^{th}$ column.

Illustrated in FIG. 4B is the circuit configuration of each pixel circuit 6 when the pixel circuit 6 is configured in a so called "6T1C" structure. Each pixel circuit 6 includes an OLED element 81, a drive transistor T1, a select transistor T2, a threshold compensation transistor T3, a reset transistor T4, select transistors T5, T6, T7 and storage capacitor $C_{ST}$. The numeral 82 denotes a power supply line kept at an internal power supply voltage Vint, the numeral 83 denotes a power supply line kept at a power supply voltage ELVDD and the numeral 84 denotes a ground line. In the configuration illustrated in FIG. 4B, a voltage corresponding to a drive voltage supplied to the pixel circuit 6 is held across the storage capacitor $C_{ST}$ and the drive transistor T1 drives the OLED element 81 in response to the voltage held across the storage capacitor $C_{ST}$.

Referring back to FIG. 4A, the display driver 2 drives the data lines 5 in response to the input image data $D_{IN}$ and control data $D_{CTRL}$ received from the host 3 and further supplies the scan control signals 8 to the scan driver circuits 7 in the display panel 1.

Figure 5:
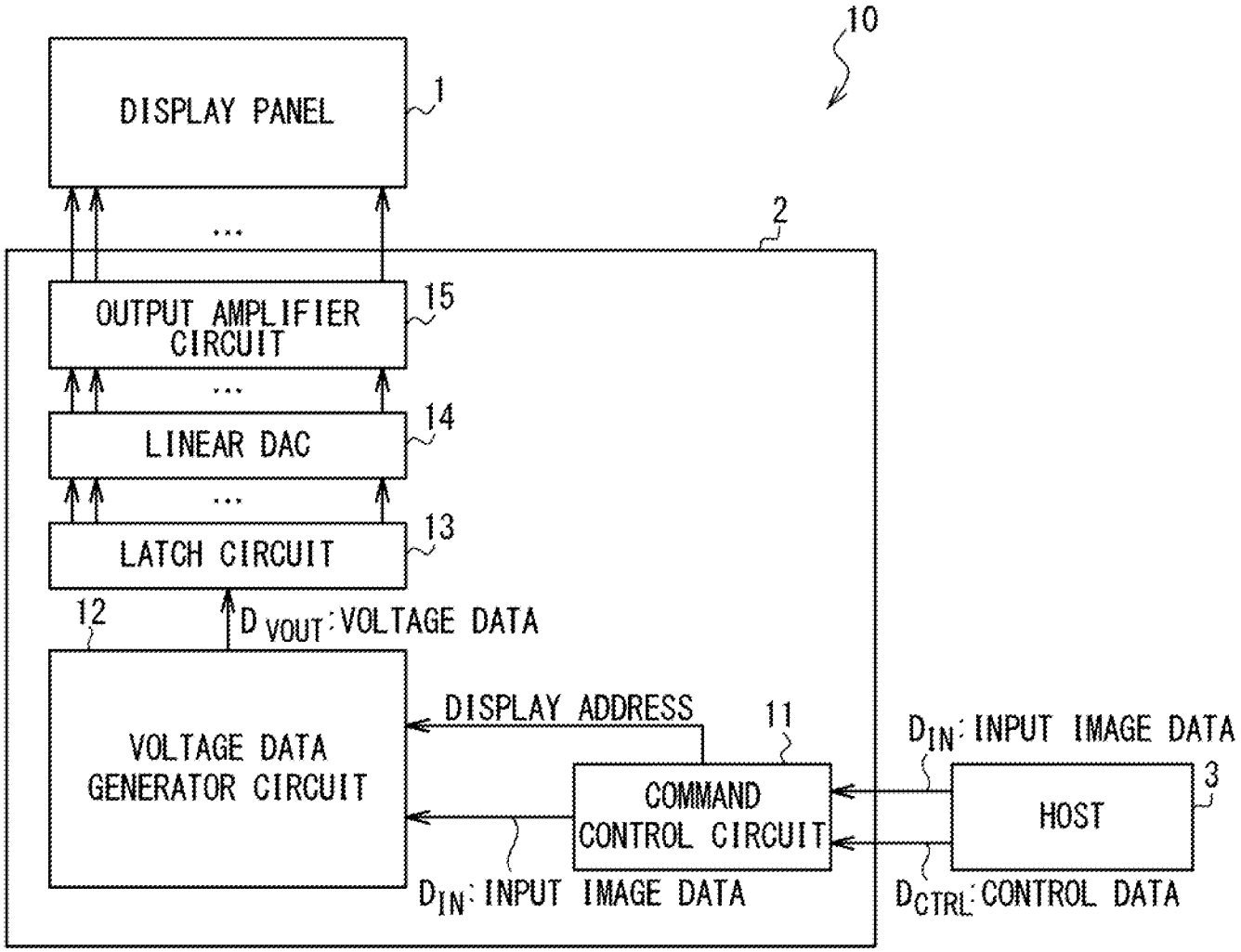
FIG. 5 is a block diagram schematically illustrating the configuration of a display driver in the first embodiment.

FIG. 5 is a block diagram schematically illustrating the configuration of the display driver 2 in the present embodiment. Illustrated in FIG. 5 is the configuration of a part of the display driver 2 which is relevant to the driving of the data lines 5.

The display driver 2 includes a command control circuit 11, a voltage data generator circuit 12, a latch circuit 13, a linear DAC (digital-analog converter) 14 and an output amplifier circuit 15.

The command control circuit 11 forwards the input image data $D_{IN}$ received from the host 3 to a data correction circuit 24A. Additionally, the command control circuit 11 controls the respective circuits of the display driver 2 in response to various control parameters and commands included in the control data $D_{CTRL}$.

The voltage data generator circuit 12 generates voltage data $D_{VOUT}$ from the input image data $D_{IN}$ received from the command control circuit 11. The voltage data $D_{VOUT}$ are data specifying the voltage levels of drive voltages to be supplied to the data lines 5 of the display panel 1 (that is, drive voltages to be supplied to the pixel circuits 6 connected to a selected scan line 4). In the present embodiment, the voltage data generator circuit 12 holds a correction data associated with each pixel circuit 6 of the display panel 1, that is, each subpixel (the R, G, and B subpixels) of each pixel of the display panel 1 and is configured to perform correction calculation in response to the correction data for each pixel circuit 6 in generating the voltage data $D_{VOUT}$. Details of the configuration of the voltage data generator circuit 12 and data processing performed in the same will be described later.

The latch circuit 13 is configured to sequentially receive the voltage data $D_{VOUT}$ from the voltage data generator circuit 12 and hold the voltage data $D_{VOUT}$ associated with the respective data lines 5.

The linear DAC 14 generates analog voltages corresponding to the respective voltage data $D_{VOUT}$ held by the latch circuit 13. In the present embodiment, the linear DAC 14 generates analog voltages having voltage levels proportional to the values of the corresponding voltage data $D_{VOUT}$.

The output amplifier circuit 15 generates drive voltages corresponding to the analog voltages generated by the linear DAC 14 and supplies the generated drive voltages to the data lines 5 associated therewith. In the present embodiment, the output amplifier circuit 15 is configured to provide impedance conversion and generate drive voltages having the same voltage levels as those of the analog voltages generated by the linear DAC 14.

Figure 6:
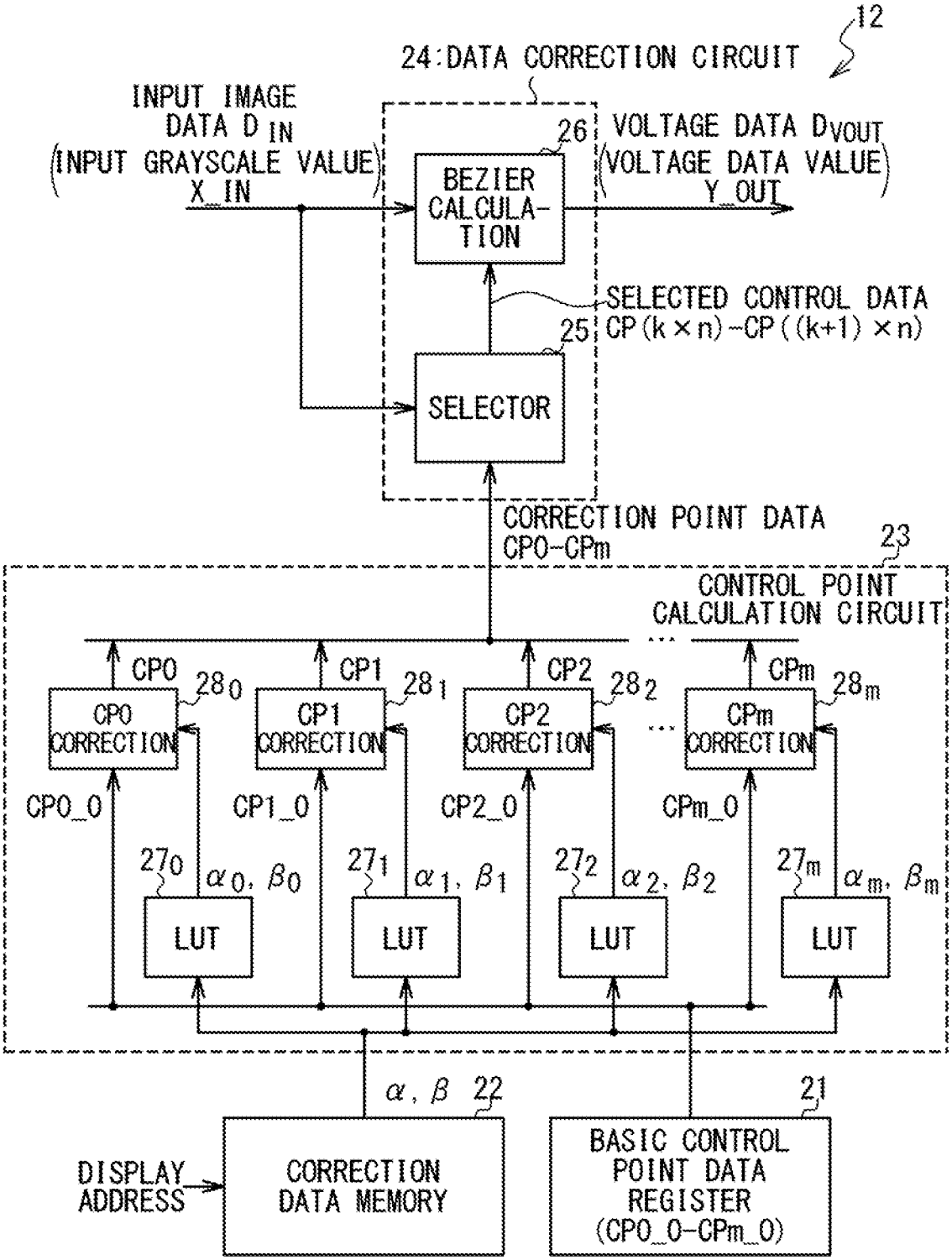
FIG. 6 is a block diagram illustrating the configuration of a voltage data generator circuit in the first embodiment.

In the present embodiment, the drive voltages supplied to the respective data lines 5 have voltage levels proportional to the values of the voltage data $D_{VOUT}$ and data processing to be performed on the input image data $D_{IN}$ (for example, correction calculation) is performed by the voltage data generator circuit 12. FIG. 6 is a block diagram illustrating the configuration of the voltage data generator circuit 12.

In the present embodiment, the voltage data generator circuit 12 includes a basic control point data register 21, a correction data memory 22, a control point calculation circuit 23 and a data correction circuit 24.

The basic control point data register 21 operates as a storage circuit storing therein basic control point data CP0_0 to CPm_0. The basic control point data CP0_0 to CPm_0 referred herein are data which specify a basic correspondence relationship between the grayscale values of the input image data $D_{IN}$ and the values of the voltage data $D_{VOUT}$.

Figure 7:
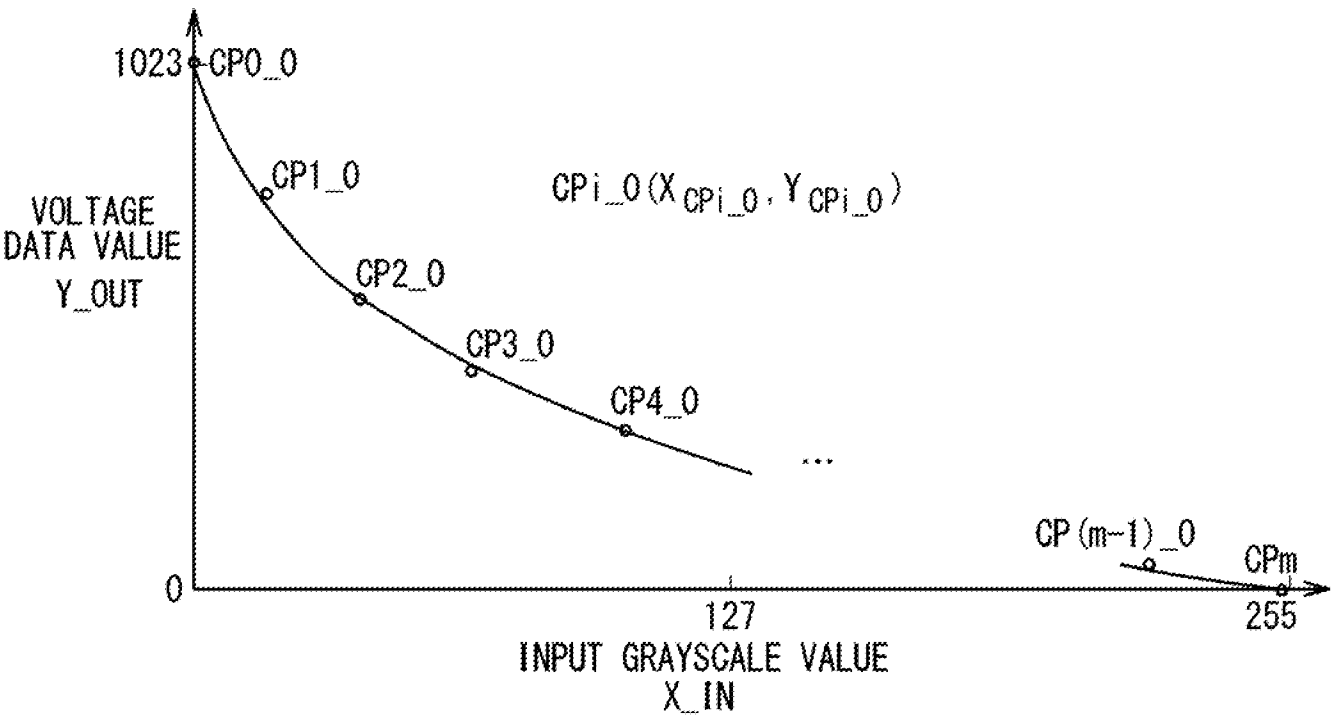
FIG. 7 is a graph schematically illustrating a basic control point data and the curve of the correspondence relationship specified by the basic control point data.

FIG. 7 is a graph schematically illustrating the basic control point data CP0_0 to CPm_0 and the curve of the correspondence relationship specified thereby. The basic control point data CP0_0 to CPm_0 are a set of data which specify coordinates of basic control points which specify the basic correspondence relationship between the grayscale value described in the input image data $D_{IN}$ (referred to as "input grayscale values X_IN", hereinafter) and the value of the voltage data $D_{VOUT}$ (referred to as "voltage data values Y_OUT", hereinafter) in an XY coordinate system in which the X axis corresponds to the input grayscale value X_IN and the Y axis corresponds to the voltage data value Y_OUT. Hereinafter, the basic control point the coordinates of which are specified by the basic control point data CPi_0 may be also referred to as the basic control point CPi_0. FIG. 7 illustrates the curve of the correspondence relationship when the input grayscale value X_IN is an eight-bit value and the voltage data value Y_OUT is a 10-bit value.

The basic control point data CPi_0 is data including the coordinates ($X_{CPi_0}$, $Y_{CPi_0}$) of the basic control point CPiO in the XY coordinate system, where i is an integer from 0 to m, $X_{CPi_0}$ is the X coordinate of the basic control point CPiO (that is, the coordinate indicating the position in a direction along the X axis direction), and $Y_{CPi_0}$ is the Y coordinate of the basic control point CPi_0 (that is, the coordinate indicating the position in a direction along the Y axis direction). Here, the X coordinates $X_{CPi}$ of the basic control point CPi_0 satisfy the following expression (1):

$$X_{CP0_0}<X_{CP1_0}<\ldots<X_{CPi_0}<\ldots<X_{CP(m-1)_0}<X_{CPm_0},$$

where the X coordinate $X_{CP0_0}$ of the basic control point CP0_0 is the allowed minimum value of the input grayscale value X_IN (that is, "0") and the X coordinate $X_{CPm_0}$ of the basic control point CPm_0 is the allowed maximum value of the input grayscale value X_IN (that is, "255").

Referring back to FIG. 6, the correction data memory 22 stores therein correction data α and β for each pixel circuit 6 (that is, each subpixel of each pixel) of the display panel 1. The correction data α and β are used for correction of the basic control point data CP0_0 to CPm_0. As is described later in detail, the correction data α are used for correction of the X coordinates $X_{CP0_0}$ to $X_{CPm_0}$ of the basic control points described in the basic control point data CP0_0 to CPm_0 and the correction data β are used for correction of the Y coordinates $Y_{CP0_0}$ to $Y_{CPm_0}$ of the basic control points described in the basic control point data CP0_0 to CPm_0. When the value of the voltage data $D_{VOUT}$ corresponding to a certain pixel circuit 6 is calculated, the display address corresponding to the pixel circuit 6 of interest is given to the correction data memory 22 and the correction data α and β specified by the display address (that is, the correction data α and β associated with the pixel circuit 6) are read out and used for correction of the basic control point data CP0_0 to CPm_0. The display address may be supplied from the command control circuit 11, for example (see FIG. 5).

The control point calculation circuit 23 generates control point data CP0 to CPm by correcting the basic control point data CP0_0 to CPm_0 in response to the correction data α and β received from the correction data memory 22. The control point data CP0 to CPm are a set of data which specify the correspondence relationship between the input grayscale value X_IN and the voltage data value Y_OUT in calculating the voltage data value Y_OUT by the data correction circuit 24. The control point data CPi includes the coordinates ($X_{CPi}$, $Y_{CPi}$) of the control point CPi in the XY coordinate system. The configuration and operation of the control point calculation circuit 23 will be described later in detail.

The data correction circuit 24 generates the voltage data $D_{VOUT}$ from the input image data $D_{IN}$ in response to the control point data CP0 to CPm received from the control point calculation circuit 23. When generating the voltage data $D_{VOUT}$ with respect to a certain pixel circuit 6, the data correction circuit 24 calculates the voltage data value Y_OUT to be described in the voltage data $D_{VOUT}$ from the input grayscale value X_IN described in the input image data $D_{IN}$ in accordance with the correspondence relationship specified by the control point data CP0 to CPm associated with the pixel circuit 6 of interest. In the present embodiment, the data correction circuit 24 calculates the Y coordinate of the point which is positioned on the $n^{th}$ degree Bezier curve specified by the control point data CP0 to CPm and has an X coordinate equal to the input grayscale value X_IN, and outputs the calculated Y coordinate as the voltage data value Y_OUT, where n is an integer equal to or more than two.

More specifically, the data correction circuit 24 includes a selector 25 and a Bezier calculation circuit 26.

The selector 25 selects control point data CP(k×n) to CP((k+1)×n) corresponding to (n+1) control points from among the control point data CP0 to CPm. Hereinafter, the control point data CP(k×n) to CP((k+1)×n) selected by the selector 25 may be referred to as selected control point data CP(k×n) to CP((k+1)×n). The selected control point data CP(k×n) to CP((k+1)×n) are selected to satisfy the following expression (2):

$$X_{CP(k\times n)}\leq X_IN\leq X_{CP((k+1)\times n)}, \quad (2)$$

where $X_{CP(k\times n)}$ is the X coordinate of the control point CP(k×n) and $X_{CP((k+1)\times n)}$ is the X coordinate of the control point CP((k+1)×n).

The Bezier calculation circuit 26 calculates the voltage data value Y_OUT corresponding to the input grayscale value X_IN on the basis of the selected control point data CP(k×n) to CP((k+1)×n). The voltage data value Y_OUT is calculated as the Y coordinate of the point which is positioned on the $n^{th}$ degree Bezier curve specified by the (n+1) control points CP(k×n) to CP((k+1)×n) described in the selected control point data CP(k×n) to CP((k+1)×n) and has an X coordinate equal to the input grayscale value X_IN. It should be noted that an $n^{th}$ degree Bezier curve can be specified by (n+1) control points.

Next, a description is given of the configuration of the control point calculation circuit 23. The control point calculation circuit 23 includes LUT (lookup table) $\mathbf{27}_0$ to $\mathbf{27}_m$ and correction point correction circuits $\mathbf{28}_0$ to $\mathbf{28}_m$.

The LUT $\mathbf{27}_0$ to $\mathbf{27}_m$ operate as a correction value calculation circuit which calculates correction values $\alpha_0$ to $\alpha_m$ and $\beta_0$ to $\beta_m$ used for correction of the basic control point data CP0_0 to CPm_0 from the correction data α and β. Here, the correction values $\alpha_0$ to $\alpha_m$, which are values calculated from the correction data α, are used for correction of the X coordinates $X_{CP0_0}$ to $X_{CPm_0}$ of the basic control points described in the basic control point data CP0_0 to CPm_0. On the other hand, the correction values $\beta_0$ to $\beta_m$, which are values calculated from the correction data β, are used for correction of the Y coordinates $Y_{CP0_0}$ to $Y_{CPm_0}$ of the basic control points described in the basic control point data CP0_0 to CPm_0.

More specifically, the LUT $\mathbf{27}_i$ determines the correction value $\alpha_i$ used for the correction of the basic control point data CPi_0 from the correction data α through table lookup, and determines the correction value $\beta_i$ used for the correction of the basic control point data CPi_0 from the correction data β through table lookup, where i is any integer from zero to m. It should be noted that, in this configuration, the correction data α is commonly used for calculation of the correction values $\alpha_0$ to $\alpha_m$ and the correction data β is commonly used for calculation of the correction values $\beta_0$ to $\beta_m$.

The control point correction circuits $\mathbf{28}_0$ to $\mathbf{28}_m$ calculate the control point data CP0 to CPm by correcting the basic control point data CP0_0 to CPm_0 on the basis of the correction values $\alpha_0$ to $\alpha_m$ and $\beta_c$, to $\beta_m$. More specifically, the control point correction circuit $\mathbf{28}_i$ calculates the correction point data CPi by correcting the basic control point data CPi_0 on the basis of the correction values $\alpha_i$ and $\beta_i$. As described above, the correction value $\alpha_i$ is used for correction of the X coordinate $X_{CPi_0}$ of the basic control point CPi_0 described in the basic control point data CPi_0, that is, calculation of the X coordinate $X_{CPi}$ of the control point CPi and the correction value $\beta_i$ is used for correction of the Y coordinate $Y_{CPi_0}$ of the basic control point CPi_0 described in the basic control point data CPi_0, that is, calculation of the Y coordinate $Y_{CPi}$ of the control point CPi.

In one embodiment, the X coordinate $X_{CPi}$ and Y coordinate $Y_{CPi}$ of the control point CPi described in the control point data CPi are calculated in accordance with the following expressions (3) and (4):

$$X_{CPi}=\alpha_i\times X_{CPi_0}, \text{ and} \tag{3}$$

$$Y_{CPi}=Y_{CPi_0}+\beta_i. \tag{4}$$

In other words, the X coordinate $X_{CPi}$ of the control point CPi is calculated depending on (in this embodiment, to be equal to) the product of the correction value $\alpha_i$ and the X coordinate $X_{CPi_0}$ of the basic control point CPi_0 and the Y coordinate $Y_{CPi}$ of the control point CPi is calculated depending on (in this embodiment, to be equal to) the sum of the correction value $\beta_i$ and the Y coordinate $Y_{CPi_0}$ of the basic control point CPi_0. The data correction circuit 24 generates the voltage data $D_{VOUT}$ from the input image data $D_{IN}$ in accordance with the correspondence relationship between the input grayscale value X_IN and the voltage data value Y_OUT specified by the control point data CP0 to CPm thus calculated.

Figure 3:
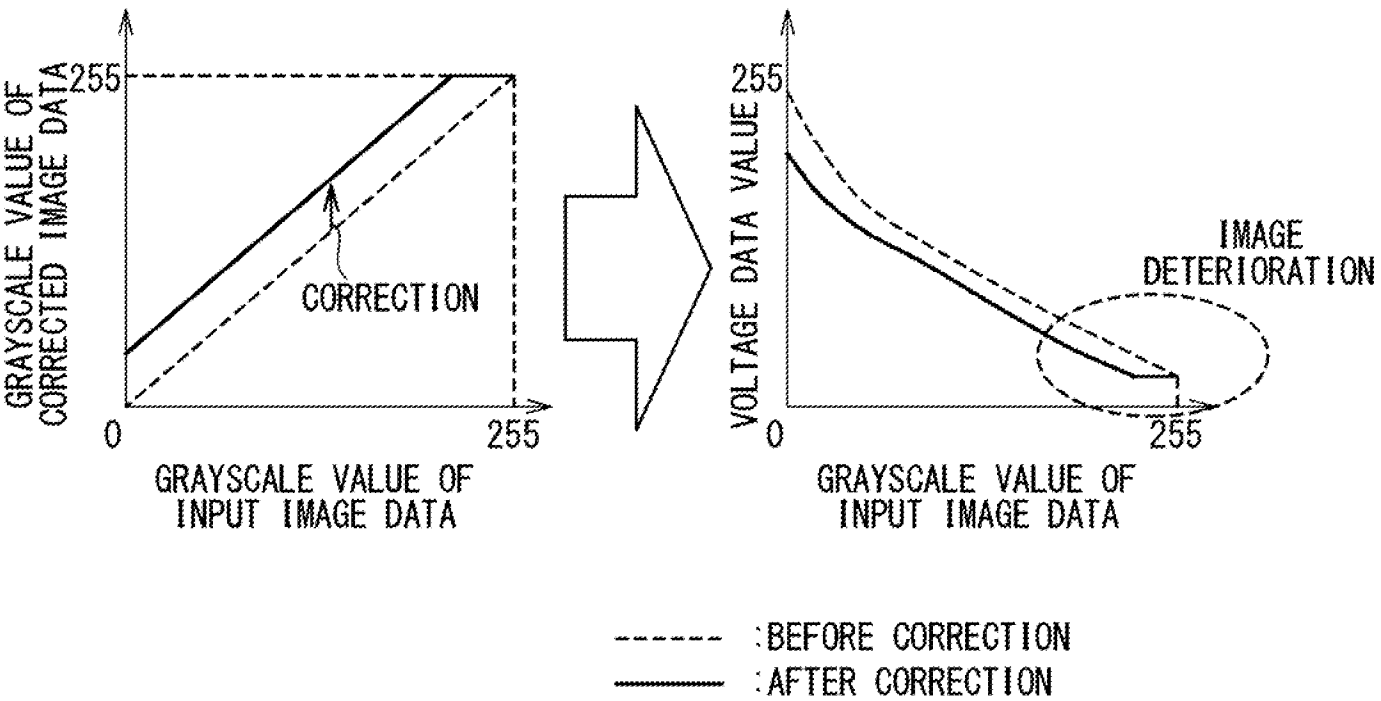
FIG. 3 is a diagram illustrating a problem that an appropriate correction is not achieved when the grayscale value of an input image data is closed to the allowed maximum or allowed minimum grayscale value.

The configuration of the voltage data generator circuit 12 of the present embodiment, in which the control point data CP0 to CPm are calculated through correcting the basic control point data CP0_0 to CPm_0 on the basis of the correction data α and β associated with each pixel circuit 6 and the voltage data value Y_OUT is calculated from the input grayscale value X_IN in accordance with the correspondence relationship specified by the control point data CP0 to CPm, is preferable for suppressing image quality deterioration. The configuration of the present embodiment avoids the problem in which grayscale values of the corrected image data are saturated at the allowed maximum or allowed minimum value, differently from the circuit configuration illustrated in FIG. 3. Additionally, the present embodiment substantially achieves correction of a drive voltage through the calculation of the Y coordinates $Y_{CPi}$ of the control points CPi through correcting the Y coordinates $Y_{CPi_0}$ of the basic control points CPi_0. The correction of the Y coordinates $Y_{CPi}$ of the control points CPi is equivalent to the correction of the voltage data value Y_OUT, that is, the correction of the drive voltage. Accordingly, the voltage data value Y_OUT, that is the drive voltage can be set so as to cancel the voltage offset of each pixel circuit 6 of the display panel 1 by appropriately setting the correction values $\beta_0$ to $\beta_m$ or the correction data β, which are used for calculating the Y coordinates $Y_{CPi}$ of the control points CPi.

Figure 8A:
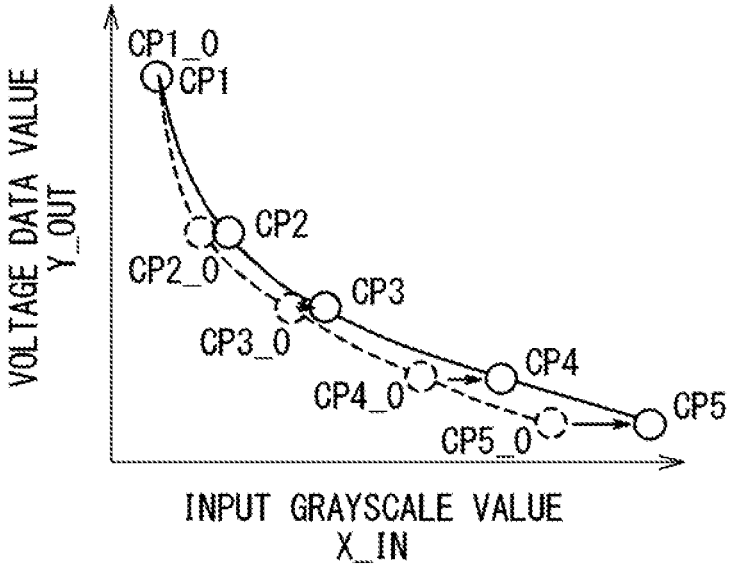
FIG. 8A is a graph illustrating an effect of a correction based on correction values $\alpha_0$ to $\alpha_m$.

The above-described correction in accordance with the expressions (3) and (4) are especially suitable for compensating the variations in the properties of the pixel circuits 6 when the pixel circuits 6 of the display panel 1 each incorporate an OLED element. FIG. 8A is a graph illustrating the effect of the correction based on the correction values $\alpha_0$ to $\alpha_m$ and FIG. 8B is a graph illustrating the effect of the correction based on the correction values $\beta_0$ to $\beta_m$.

When the display panel 1 is configured as an OLED display panel, causes of variations in the properties of the pixel circuits 6 may include variations in the current-voltage properties of the OLED elements included in the pixel circuits 6 and variations in the threshold voltages of the drive transistors included in the pixel circuits 6. Causes of the variations in the current-voltage properties of the OLED elements may include variations in the areas of the OLED elements, for example. It is desired to appropriately compensate the above-described variations for improving the image quality of the display panel 1.

With reference to FIG. 8A, calculating the X coordinate $X_{CPi}$ of the control point CPi depending on the product of the correction value $\alpha_i$ and the X coordinate $X_{CPi_0}$ of the basic control points CPi_0 is effective for compensating the variations in the current-voltage properties. The calculation of the coordinate $X_{CPi}$ of the control point CPi depending on the product of the correction value $\alpha_i$ and the X coordinate $X_{CPi_0}$ of the basic control points CPi_0 is equivalent to enlargement or shrinking of the curve of the correspondence relationship between the input grayscale value X_IN and the voltage data value Y_OUT in the X axis direction, in other words, equivalent to the calculation of the product of the input grayscale value X_IN and a correction value. This is effective for compensating the variations in the current-voltage properties.

Figure 8B:
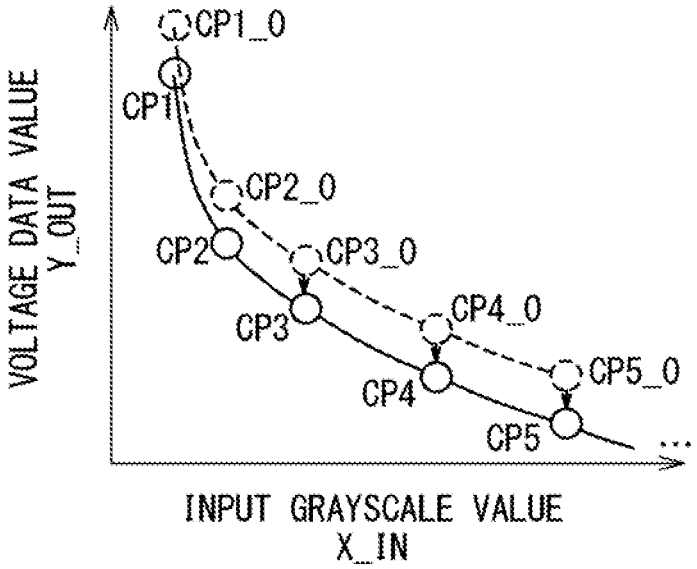
FIG. 8B is a graph illustrating an effect of a correction based on correction values $\beta_0$ to $\beta_m$.

Meanwhile, with reference to FIG. 8B, calculating the Y coordinate $Y_{CPi}$ of the control point CPi depending on the sum of the correction value $\beta_i$ and the Y coordinate $Y_{CPi_0}$ of the basic control point CPi_0 is effective for compensating the variations in the threshold voltages of the drive transistors included in the pixel circuits 6. Calculating the Y coordinate $Y_{CPi}$ of the control point CPi depending on the sum of the correction value $\beta_i$ and the Y coordinate $Y_{CPi_0}$ of the basic control point CPi_0 is equivalent to shifting the curve of the correspondence relationship between the input grayscale value X_IN and the voltage data value Y_OUT in the Y axis direction, in other words, equivalent to calculation of the sum of the voltage data value Y_OUT and a correction value. This is effective for compensating the variations in the threshold voltages of the drive transistors included in the pixel circuits 6.

Figure 9:
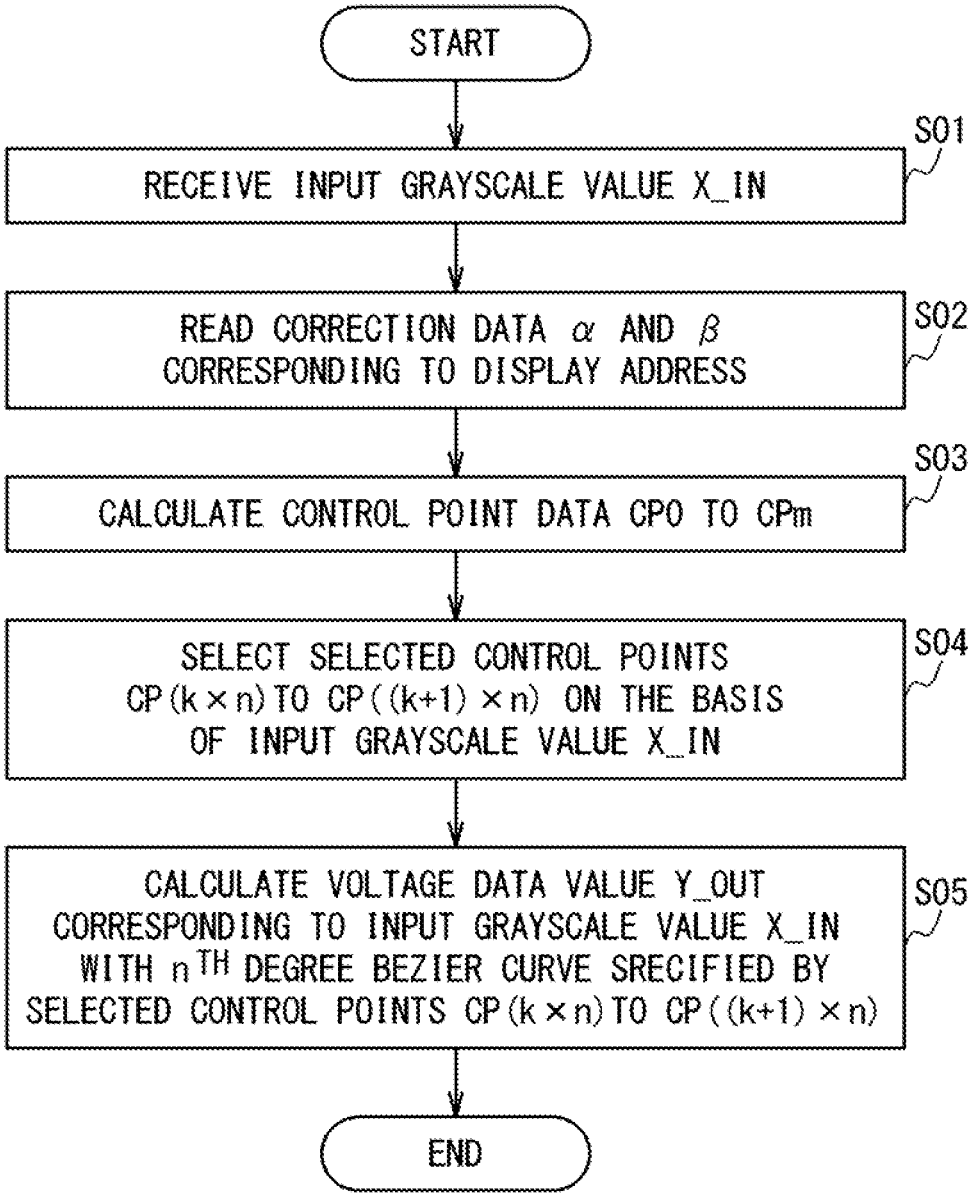
FIG. 9 is a flowchart illustrating the operation of the voltage data generator circuit in the first embodiment.

FIG. 9 is a flowchart illustrating the operation of the voltage data generator circuit 12 in the present embodiment. When the voltage data value Y_OUT specifying the drive voltage to be supplied to a certain pixel circuit 6 is calculated, the input grayscale value X_IN associated with the pixel circuit 6 is supplied to the voltage data generator circuit 12 (step S01). In the following, a description is given with an assumption that the input grayscale value X_IN is an eight-bit value and the voltage data value Y_OUT is a 10-bit value.

In synchronization with the supply of the input grayscale value X_IN to the voltage data generator circuit 12, the display address associated with the pixel circuit 6 of interest is supplied to the correction data memory 22 and the correction data α and ρ associated with the display address (that is, the correction data α and β associated with the pixel circuit 6 of interest) are read out (step S02).

The control point data CP0 to CPm actually used to calculate the voltage data value Y_OUT are calculated through correcting the basic control point data CP0_0 to CPm_0 by using the correction data α and β read out from the correction data memory 22 (step S03). The control point data CP0 to CPm are calculated as follows.

First, by using the LUTs $\mathbf{27}_0$ to $\mathbf{27}_m$, correction values $\alpha_0$ to $\alpha_m$ are calculated from the correction data α and correction values $\beta_0$ to $\beta_m$ are calculated from the correction data β. The correction value $\alpha_i$ is calculated through table lookup in the LUT $\mathbf{27}_i$ in response to the correction data α and the correction value $\beta_i$ is calculated through table lookup in the LUT $\mathbf{27}_i$ in response to the correction data β.

Subsequently, the basic control point data CP0_0 to CPm_0 are corrected by the control point correction circuits $\mathbf{28}_0$ to $\mathbf{28}_m$ on the basis of the correction values $\alpha_0$ to $\alpha_m$ and $\beta_0$ to $\beta_m$, to thereby calculate the control point data CP0 to CPm. As described above, in the present embodiment, the X coordinate $X_{CPi}$ of the control point CPi described in the control point data CPi is calculated in accordance with the above-described expression (3) and the Y coordinate $Y_{CPi}$ of the control point CPi is calculated in accordance with the above-described expression (4).

This is followed by selecting (n+1) control points CP(k×n) to CP((k+1)×n) from among the control points CP0 to CPm on the basis of the input grayscale value X_IN (step S04). The (n+1) control points CP(k×n) to CP((k+1)×n) are selected by the selector 25.

In one embodiment, the (n+1) control points CP(k×n) to CP((k+1)×n) may be selected as follows.

The basic control points CP0_0 to CPm_0 are defined to satisfy m=p×n, where p is a predetermined natural number. In this case, the number of the basic control points CP0_0 to CPm_0 and the number of the control points CP0 to CPm are m+1. The $n^{th}$ degree Bezier curve passes through the control point CP0, CPn, CP(2*n*), . . . , CP(p×n) of the m+1 control points CP0 to CPm. The other control points are not necessarily positioned on the $n^{th}$ degree Bezier curve, although specifying the shape of the $n^{th}$ degree Bezier curve.

The selector 25 compares the input grayscale value X_IN with the respective X coordinates of the control points through which the $n^{th}$ degree Bezier curve passes, and select the (n+1) control points CP(k×n) to CP((k+1)×n) in response to the result of the comparison.

More specifically, when the input grayscale value X_IN is larger than the X coordinate of the control point CP0 and smaller than the X coordinate of the control point CPn, the selector 25 selects the control points CP0 to CPn. When the input grayscale value X_IN is larger than the X coordinate of the control point CPn and smaller than the X coordinate of the control point CP(2*n*), the selector 25 selects the control points CPn to CP(2*n*). Generally, when the input grayscale value X_IN is larger than the X coordinate $X_{CP(k\times n)}$ of the control point CP(k×n) and smaller than the X coordinate $X_{CP((k+1)\times n)}$ of the control point CP((k+1)×n), the selector 25 selects the control points CP(k×n) to CP((k+1)×n), where k is an integer from 0 to p.

When the input grayscale value X_IN is equal to the X coordinate $X_{CP(k\times n)}$ of the control point CP(k×n), in one embodiment, the selector 25 selects the control points CP(k×n) to CP((k+1)×n). In this case, when the input grayscale value X_IN is equal to the control point CP(p×n), the selector 25 selects the control points CP((p−1)×n) to CP(p×n).

Alternatively, the selector 25 may select the control points CP(k×n) to CP((k+1)×n), when the input grayscale value X_IN is equal to the X coordinate $X_{CP((k+1)\times n)}$ of the control point CP((k+1)×n). In this case, when the input grayscale value X_IN is equal to the control point CP0, the selector 25 selects the control points CP0 to CPn.

The control point data of the thus-selected control points CP(k×n) to CP((k+1)×n), that is, the X and Y coordinates of the control points CP(k×n) to CP((k+1)×n) are supplied to the Bezier calculation circuit 26 and the voltage data value Y_OUT corresponding to the input grayscale value X_IN is calculated by the Bezier calculation circuit 26 (step S05). The voltage data value Y_OUT is calculated as the Y coordinate of the point which is positioned on the $n^{th}$ degree Bezier curve specified by the (n+1) control points CP(k×n) to CP((k+1)×n) and has an X coordinate equal to the input grayscale value X_IN.

The degree n of the Bezier curve used to calculate the voltage data value Y_OUT is not limited to a specific number; the degree n may be selected depending on required precision. It should be noted however that calculating the voltage data value Y_OUT with a second degree Bezier curve preferably allows precisely calculating the voltage data value Y_OUT with a simple configuration of the Bezier calculation circuit 26. In the following, a preferred configuration and operation of the Bezier calculation circuit 26 are described when the voltage data value Y_OUT is calculated by using a second degree Bezier curve. It should be noted that, when the voltage data value Y_OUT is calculated with a second degree Bezier curve, the control point data CP(2*k*), CP(2*k*+1) and CP(2*k*+2) corresponding to the three control points CP(2*k*), CP(2*k*+1) and CP(2*k*+2), that is, the X and Y coordinates of the three control points CP(2*k*), CP(2*k*+1) and CP(2*k*+2) are supplied to the input of the Bezier calculation circuit 26.

Figure 10:
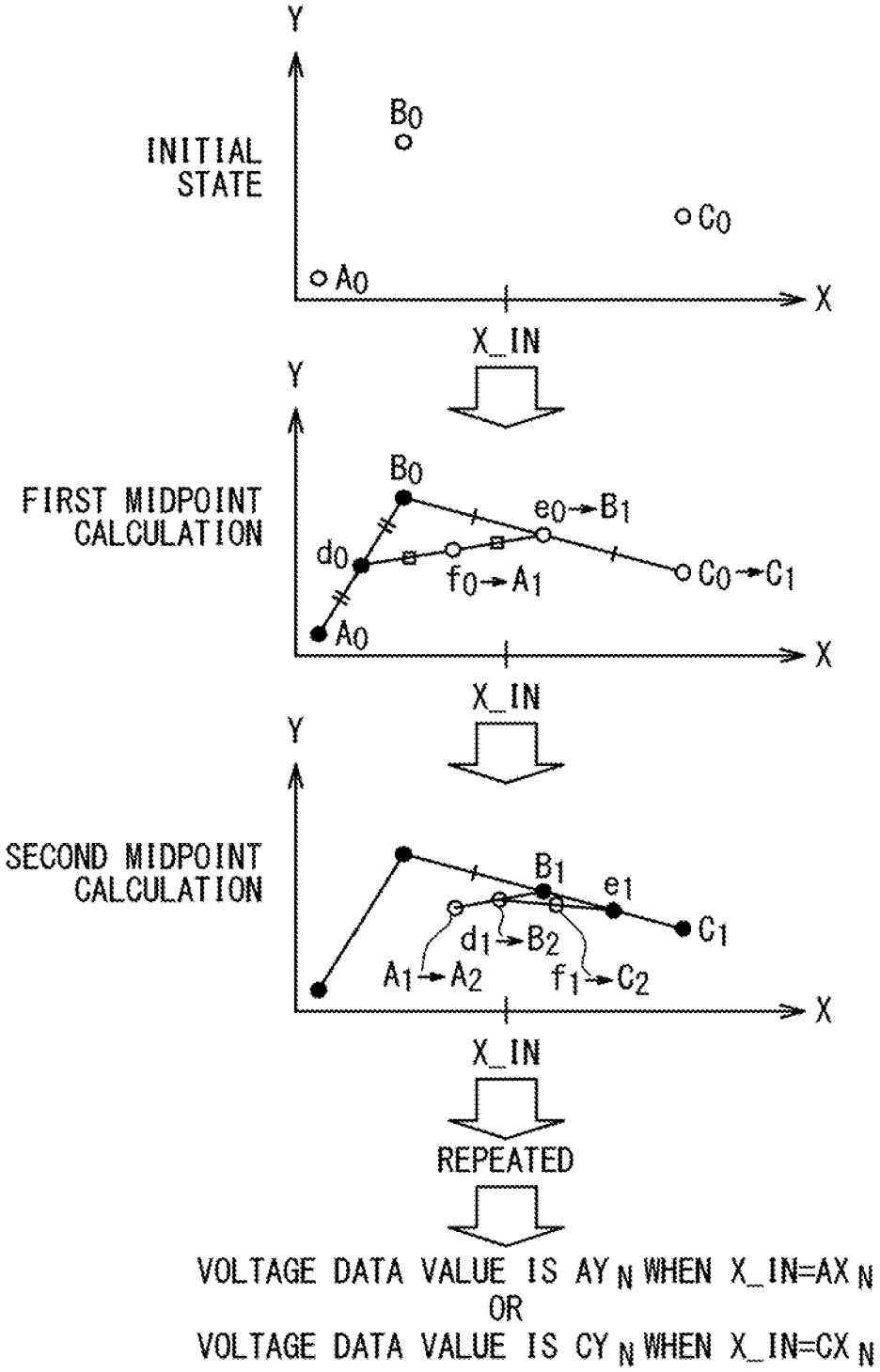
FIG. 10 is a diagram illustrating a calculation algorithm performed in a Bezier calculation circuit in the first embodiment.

In the following, a description is first given of the calculation algorithm performed in the Bezier calculation circuit 26. FIG. 10 is a conceptual diagram illustrating the calculation algorithm performed in the Bezier calculation circuit 26 and FIG. 11 is a flowchart illustrating the procedure of the calculation.

Figure 11:
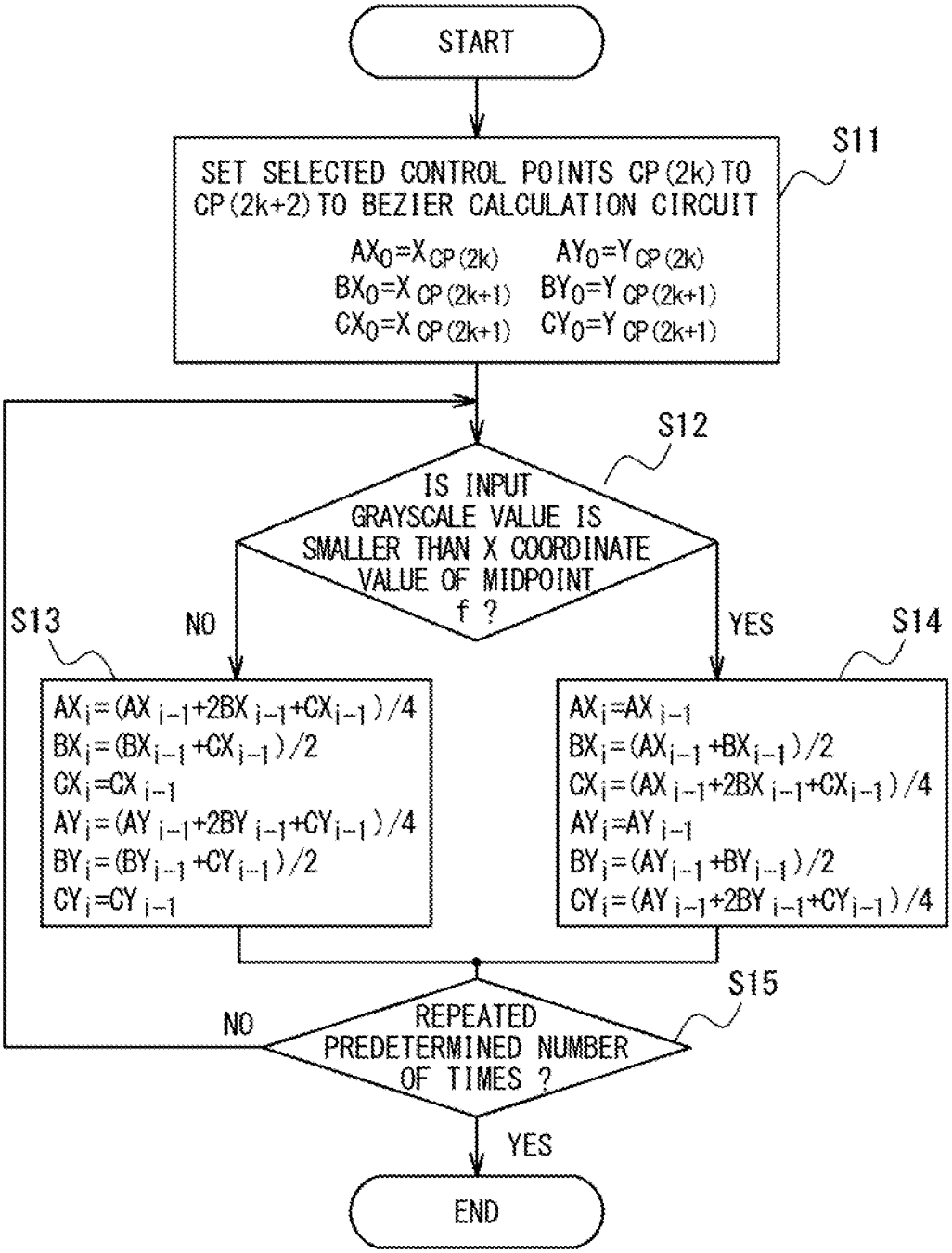
FIG. 11 is a flowchart illustrating the procedure of the calculation performed in the Bezier calculation circuit.

As illustrated in FIG. 11, the X and Y coordinates of the three control points CP(2*k*) to CP(2*k*+2) are set to the Bezier calculation circuit 26 as an initial setting (step S11). For simplicity of the description, the control points CP (2*k*), CP(2*k*+1) and CP(2*k*+2), which are set to the Bezier calculation circuit 26, are hereinafter referred to as control points $A_0$, $B_0$ and $C_0$, respectively. Referring to FIG. 11, the coordinates $A_0(AX_0, AY_0)$, $B_0(BX_0, BY_0)$ and $C_0(CX_0, CY_0)$ of the control points $A_0$, $B_0$ and $C_0$ are represented as follows:

$$A_0(AX_0,AY_0)=(X_{CP(2k)},Y_{CP(2k)}), \tag{5a}$$

$$B_0(BX_0,BY_0)=(X_{CP(2k+1)},Y_{CP(2k+1)}), \text{ and} \tag{5b}$$

$$C_0(CX_0,CY_0)=(X_{CP(2k+2)},Y_{CP(2k+2)}). \tag{5c}$$

Referring to FIG. 10, the voltage data value Y_OUT is calculated through repeated calculations of midpoints as described in the following. One unit of the repeated calculations is referred to as "midpoint calculation", hereinafter. The midpoint of adjacent two of the three control points may be referred to as first-order midpoint and the midpoint of two first-order midpoints may be referred to as second-order midpoint.

In the first midpoint calculation, with respect to the initially-given control points $A_0$, $B_0$ and $C_0$ (that is, the three control points CP(2*k*), CP(2*k*+1) and CP(2*k*+2), a first-order midpoint $d_0$ which is the midpoint of the control points $A_0$ and $B_0$ and a first-order midpoint $e_0$ which is the midpoint of the control points $B_0$ and $C_0$ are calculated and a second-order midpoint $f_0$ which is the midpoint of the first-order midpoints $d_0$ and $e_0$ is further calculated. The second-order midpoint $f_0$ is positioned on the second degree Bezier curve specified by the three control points $A_0$, $B_0$ and $C_0$. The coordinates ($X_{f0}$, $Y_{f0}$) of the second-order midpoint $f_0$ is calculated by the following expressions (6a) and (6b):

$$X_{f0}=(AX_0+2BX_0+CX_0)/4, \text{ and} \tag{6a}$$

$$Y_{f0}=(AY_0+2BY_0+CY_0)/4. \tag{6b}$$

Three control points $A_1$, $B_1$ and $C_1$ used in the next midpoint calculation (the second midpoint calculation) are selected from among the control point $A_0$, the first-order midpoint $d_0$, the second-order midpoint $f_0$, the first-order midpoint $e_0$ and the control point $B_0$ in response to the result of the comparison between the input grayscale value X_IN and the X coordinate $X_{f0}$ of the second-order midpoint $f_0$. More specifically, the control points $A_1$, $B_1$ and $C_1$ are selected as follows:

$$\text{When } X_{f0} \geq X_IN \tag{A}$$

In this case, the three points having the least three X coordinates (the leftmost three points): the control points $A_0$, the first-order midpoint $d_0$ and the second-order midpoint $f_0$ are selected as control points $A_1$, $B_1$ and $C_1$. In other words, $$A_1=A_0, B_1=d_0 \text{ and } C_1=f_0. \tag{7a}$$

$$\text{When } X_{f0} < X_IN \tag{B}$$

In this case, the three points having the most three X coordinates (the rightmost three points): the second-order midpoint $f_0$, the first order midpoint $e_O$ and the control point $C_0$ are selected as the control points $A_1$, $B_1$ and $C_1$. In other words, $$A_1=f_0, B_1=e_0 \text{ and } C_1=C_0. \tag{7b}$$

The second midpoint calculation is performed in a similar manner. With respect to the control points $A_1$, $B_1$ and $C_1$, the first-order midpoint $d_1$ of the control points $A_1$ and $B_1$ and the first-order midpoint $e_1$ of the control points $B_1$ and $C_1$ are calculated and the second-order midpoint $f_1$ of the first order midpoints $d_1$ and $e_1$ is further calculated. The second-order midpoint $f_1$ is positioned on the desired second-order Bezier curve. Subsequently, three control points $A_2$, $B_2$ and $C_2$ used in the next midpoint calculation (the third midpoint calculation) are selected from among the control point $A_1$, the first-order midpoint $d_1$, the second-order midpoint $f_1$, the first-order midpoint $e_1$ and the control point $B_1$ in response to the result of a comparison between the input grayscale value X_IN and the X coordinate $X_{f1}$ of the second-order midpoint $f_1$.

Consequently, as illustrated in FIG. 10, the calculations described below are performed in the $i^{th}$ midpoint calculation (steps S12 to S14):

$$\text{When}(AX_{i-1}+2BX_{i-1}+CX_{i-1})/4 \geq X_IN, \tag{A}$$

$$AX_i=AX_{i-1}, \tag{8a}$$

$$BX_i=+BX_{i-1})/2, \tag{9a}$$

$$CX_i=(AX_{i-1}+2BX_{i-1}+CX_{i-1})/4, \tag{10a}$$

$$AY_i=AY_{i-1}, \tag{11a}$$

$$BY_i=(AY_{i-1}+BY_{i-1})/2, \text{ and} \tag{12a}$$

$$CY_i=(AY_{i-1}+2BY_{i-1}CY_{i-1})/4. \tag{13a}$$

$$\text{When}(AX_{i-1}+2BX_{i-1}+CX_{i-1})/4 < X_IN, \tag{B}$$

$$AX_i=AX_{i-1}+2BX_{i-1}+CX_{i-1})/4, \tag{8b}$$

$$BX_i=(BX_{i-1}+CX_{i-1})/2, \tag{9b}$$

$$CX_i=CX_{i-1}, \tag{10b}$$

$$AY_i=(AY_{i-1}+2BY_{i-1}+CY_{i-1})/4, \tag{11b}$$

$$BY_i=(BY_{i-1}+CY_{i-1})/2, \text{ and} \tag{12b}$$

$$CY_i=CY_{i-1}. \tag{13b}$$

With respect to conditions (A) and (B), it would be obvious for a person skilled in the art that the equal sign may be attached to either the inequality sign recited in condition (A) or that in condition (B).

The midpoint calculations are repeated in a similar manner a desired number of times (step S15).

Each midpoint calculation makes the control points $A_i$, $B_i$ and $C_i$ closer to the second degree Bezier curve and also makes the X coordinate values of the control points $A_i$, $B_i$ and $C_i$ closer to the input grayscale value X_IN. The voltage data value Y_OUT to be finally calculated is obtained from the Y coordinate of at least one of control points $A_N$, $B_N$ and $C_N$ obtained by the N-th midpoint calculation. For example, the voltage data value Y_OUT may be determined as the Y coordinate of an arbitrarily selected one of the control points $A_N$, $B_N$, and $C_N$. Alternatively, the voltage data value Y_OUT may be determined as the average value of the Y coordinates of the control points $A_N$, $B_N$ and $C_N$.

In a range in which the number of times N of the midpoint calculations is relatively small, the preciseness of the voltage data value Y_OUT is more improved as the number of times N of the midpoint calculations is increased. It should be noted however that, once the number of times N of the midpoint calculations reaches the number of bits of the voltage data value Y_OUT, the preciseness of the voltage data value Y_OUT is not further improved thereafter. Accordingly, it is preferable that the number of times N of the midpoint calculations is equal to the number of bits of the voltage data value Y_OUT. In the present embodiment, in which the voltage data value Y_OUT is a 10-bit data, it is preferable that the number of times N of the midpoint calculations is 10.

Figure 12:
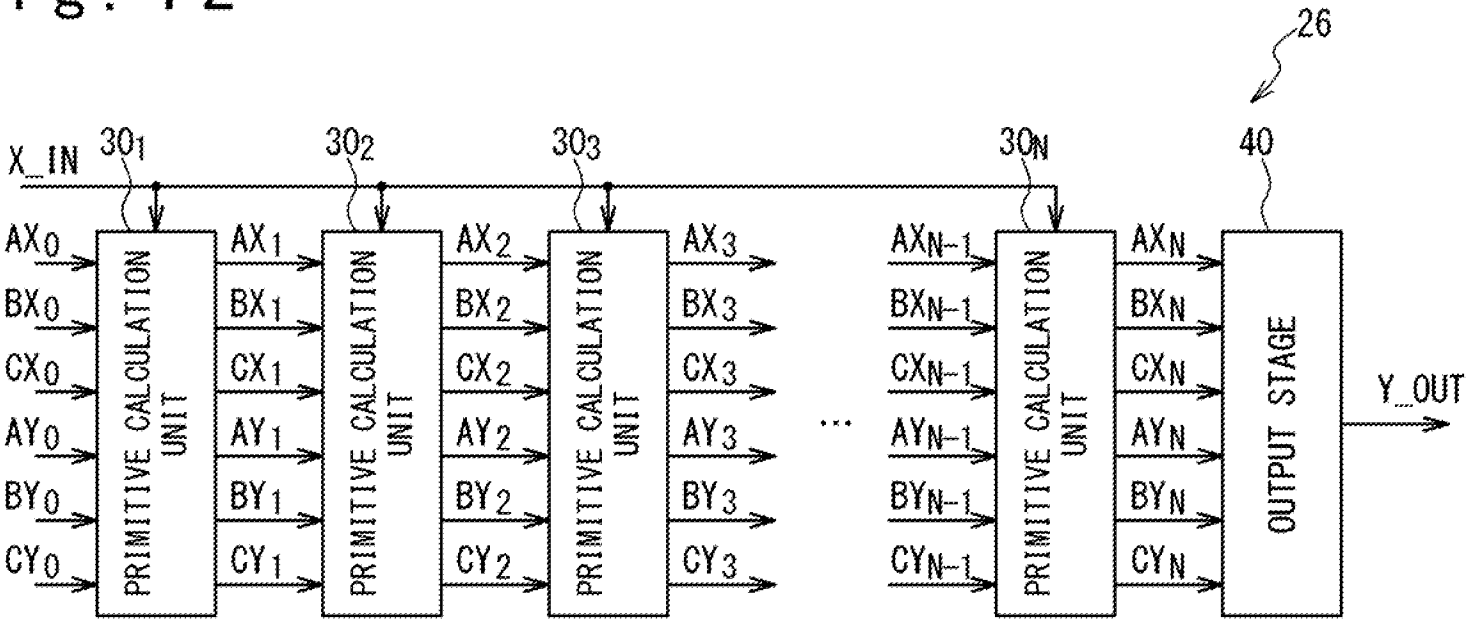
FIG. 12 is a block diagram illustrating one example of the configuration of the Bezier calculation circuit.

Since the voltage data value Y_OUT is calculated through repeated midpoint calculations as described above, the Bezier calculation circuit 26 may be configured as a plurality of serially-connected calculation circuits each configured to perform a midpoint calculation. FIG. 12 is a block diagram illustrating one example of the configuration of the Bezier calculation circuit 26 thus configured.

The Bezier calculation circuit 26 includes N primitive calculation units $\mathbf{30}_1$ to $\mathbf{30}_N$ and an output stage 40. Each of the primitive calculation units $\mathbf{30}_1$ to $\mathbf{30}_N$ is configured to perform the above-described midpoint calculation. In other words, the primitive calculation unit $\mathbf{30}_i$ is configured to calculate the X and Y coordinates of the control points $A_i$, $B_i$ and $C_i$ from the X and Y coordinates of the control points $A_{i-1}$, $B_{i-1}$ and $C_{i-1}$ through calculations in accordance with expressions (8a) to (13a) and (8b) to (13b). The output stage 40 outputs the voltage data value Y_OUT on the basis of the Y coordinate of at least one control point selected from the control points $A_N$, $B_N$ and $C_N$, which is output from the primitive calculation unit $\mathbf{30}_N$ (that is, on the basis of at least one of $AY_N$, $BY_N$ and $CY_N$). The output stage 40 may output the Y coordinate of a selected one of the control points $A_N$, $B_N$ and $C_N$ as the voltage data value Y_OUT.

Figure 13:
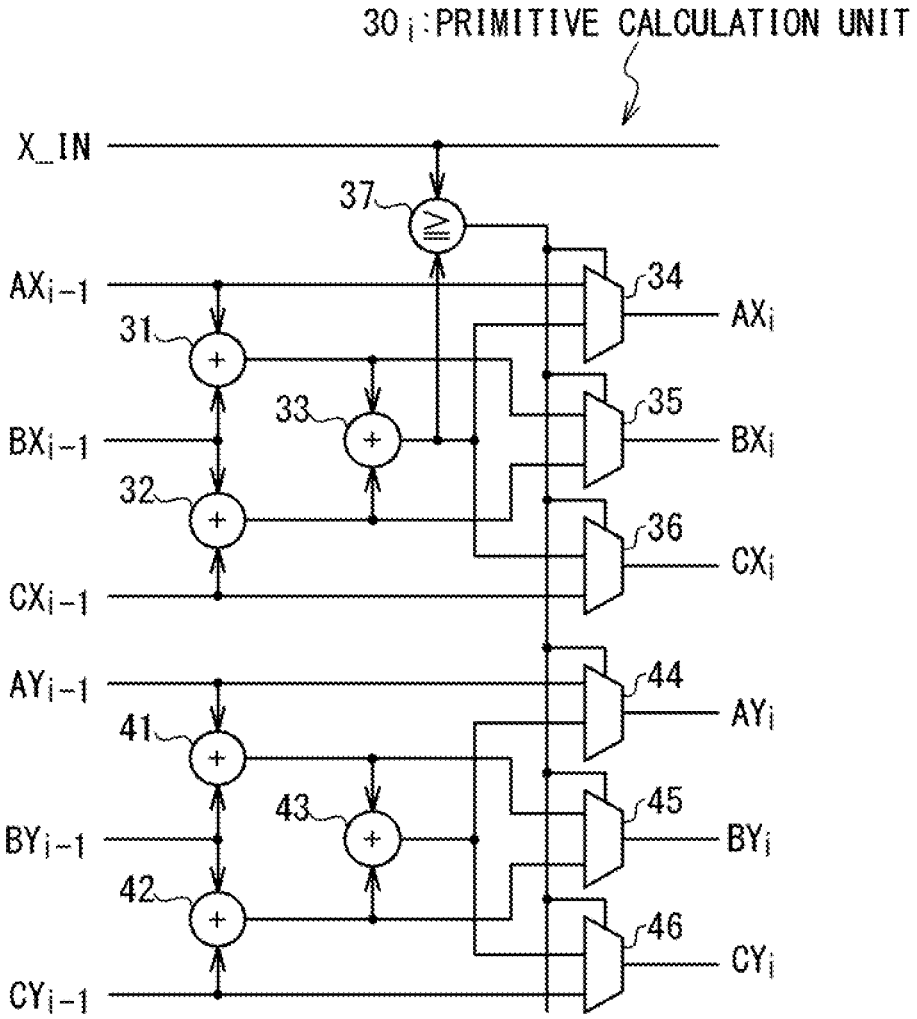
FIG. 13 is a circuit diagram illustrating the configuration of each primitive calculation unit.

FIG. 13 is a circuit diagram illustrating the configuration of each primitive calculation unit $\mathbf{30}_i$. Each primitive calculation unit 30 includes adders 31 to 33, selectors 34 to 36, a comparator 37, adders 41 to 43, and selectors 44 to 46. The adders 31 to 33 and the selectors 34 to 36 perform calculations on the X coordinates of the control points $A_{i-1}$, $B_{i-1}$, and $C_{i-1}$ and the adders 41 to 43 and the selectors 44 to 46 perform calculations on the Y coordinates of the control points $A_{i-1}$, $B_{i-1}$, and $C_{i-1}$.

Each primitive calculation unit 30 includes seven input terminals, one of which receives the input grayscale value X_IN, and the remaining six receive the X coordinates $AX_{i-1}$, $BX_{i-1}$ and $CX_{i-1}$ and Y coordinates $AY_{i-1}$, $BY_{i-1}$ and $CY_{i-1}$ of the control points $A_{i-1}$, $B_{i-1}$ and $C_{i-1}$, respectively. The adder 31 has a first input connected to the input terminal to which $AX_{i-1}$ is supplied and a second input connected to the input terminal to which $BX_{i-1}$ is supplied. The adder 32 has a first input connected to the input terminal to which $BX_{i-1}$ is supplied and a second input connected to the input terminal to which $CX_{i-1}$ is supplied. The adder 33 has a first input connected to the output of the adder 31 and a second input connected to the output of the adder 32.

Correspondingly, the adder 41 has a first input connected to the input terminal to which $AY_{i-1}$ is supplied and a second input connected to the input terminal to which $BY_{i-1}$ is supplied. The adder 42 has a first input connected to the input terminal to which $BY_{i-1}$ is supplied and a second input connected to the input terminal to which $CY_{i-1}$ is supplied. The adder 43 has a first input connected to the output of the adder 41 and a second input connected to the output of the adder 42.

The comparator 37 has a first input to which the input gray-level value X_IN is supplied and a second input connected to the output of the adder 33.

The selector 34 has a first input connected to the input terminal to which $AX_{i-1}$ is supplied and a second input connected to the output of the adder 33, and selects the first or second input in response to the output value of the comparator 37. The output of the selector 34 is connected to the output terminal from which $AX_i$ is output. Similarly, the selector 35 has a first input connected to the output of the adder 31 and a second input connected to the output of the adder 32, and selects the first or second input in response to the output value of the comparator 37. The output of the selector 35 is connected to the output terminal from which $BX_i$ is output. Furthermore, the selector 36 has a first input connected to the output of the adder 33 and a second input connected to the input terminal to which $C_{i-1}$ is supplied, and selects the first or second input in response to the output value of the comparator 37. The output of the selector 36 is connected to the output terminal from which $CX_i$ is output.

The similar goes for the selectors 44 to 46. The selector 44 has a first input connected to the input terminal to which $AY_{i-1}$ is supplied and a second input connected to the output of the adder 43, and selects the first or second input in response to an output value of the comparator 37. The output of the selector 44 is connected to the output terminal from $AY_i$ is output. Similarly, the selector 45 has a first input connected to the output of the adder 41 and a second input connected to the output of the adder 42, and selects the first or second input in response to the output value of the comparator 37. The output of the selector 45 is connected to the output terminal from which $BY_i$ is output. Further, the selector 46 has a first input connected to the output of the adder 43 and a second input connected to the input terminal to which $CY_{i-1}$ is supplied, and selects the first or second input in response to the output value of the comparator 37. The output of the selector 46 is connected to the output terminal from which $CY_i$ is output.

In the primitive calculation unit $\mathbf{30}_i$ thus configured, the adder 31 performs the calculation in accordance with the above-described expression (9a), the adder 32 performs the calculation in accordance with the above-described expression (9b), and the adder 33 performs the calculation in accordance with (10a) and (8b) using the output values from the adders 31 and 32. Similarly, the adder 41 performs the calculation in accordance with the above-described expression (12a), the adder 42 performs the calculation in accordance with the expression (12b), and the adder 43 performs the calculation in accordance with expressions (13a) and (11b) using the output values from the adders 41 and 42. The comparator 37 compares the output value of the adder 33 with the input grayscale value X_IN, and indicates which of the two input values supplied to each of the selectors 34 to 36 and 44 to 46 is to be output as the output value. When the input grayscale value XIN is smaller than $(AX_{i-1}++CX_{i-1})/4$, the selector 34 selects $AX_{i-1}$, the selector 35 selects the output value of the adder 31, the selector 36 selects the output value of the adder 33, the selector 44 selects $AY_{i-1}$, the selector 45 selects the output value of the adder 41, and the selector 46 selects the output value of the adder 43. When the input gray-level value X_IN is larger than $(AX_{i-1}+2BX_{i-1}+CX_{i-1})/4$, the selector 34 selects the output value of the adder 33, the selector 35 selects the output value of the adder 32, the selector 36 selects the $CX_{i-1}$, the selector 44 selects the output value of the adder 43, the selector 45 selects the output value of the adder 42, and the selector 46 selects $CY_{i-1}$. The values selected by the selectors 34 to 36 and 44 to 46 are supplied to the primitive calculation unit 30 of the following stage as $AX_i$, $BX_i$, $CX_i$, $AY_i$, $BY_i$, and $CY_i$, respectively.

It should be noted here that divisions included in expressions (8a) to (13a) and (8b) to (13b) can be realized by truncating lower bits. Most simply, desired calculations can be achieved by truncating lower bits of the outputs of the adders 31 to 33 and 41 to 43. In this case, one bit may be truncated from each of the output terminals of the adders 31 to 33 and 41 to 43. It should be noted however that the positions where the lower bits are truncated in the circuit may be arbitrarily modified as long as calculations equivalent to the expressions (8a) to (13a) and (8b) to (13b) are achieved. For example, lower bits may be truncated at the input terminals of the adders 31 to 33 and 41 to 43 or on the input terminals of the comparator 37 and the selectors 34 to 36 and 44 to 46.

The voltage data value Y_OUT to be finally calculated can be obtained from at least one of $AY_N$, $BY_N$ and $CY_N$ output from the final primitive calculation unit $\mathbf{30}_N$ of the primitive calculation units $\mathbf{30}_1$ to $\mathbf{30}_N$ thus configured.

Figure 14:
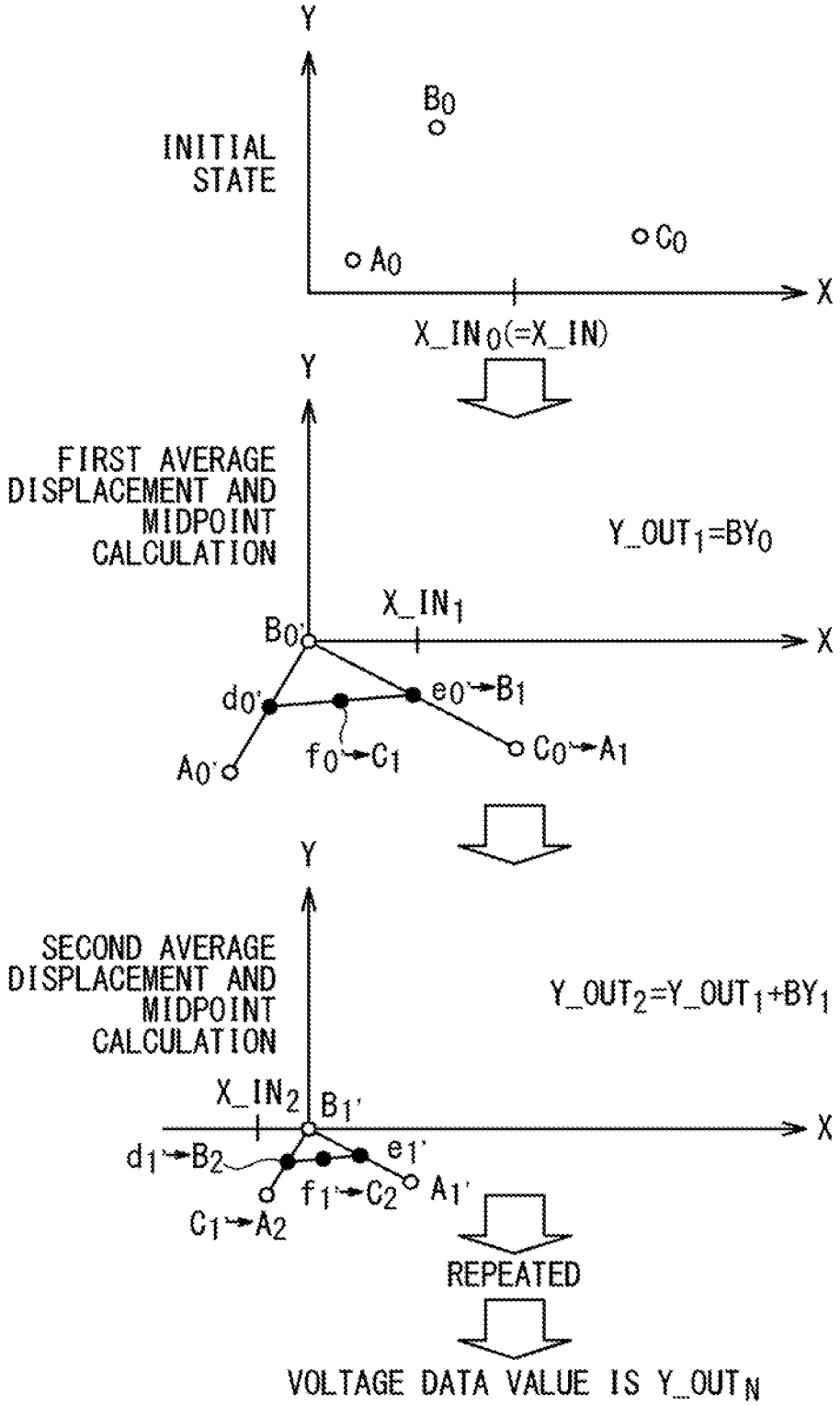
FIG. 14 is a diagram illustrating an improved calculation algorithm performed in the Bezier calculation circuit.

FIG. 14 is a conceptual diagram illustrating an improved calculation algorithm for calculating the voltage data value Y_OUT when a second degree Bezier curve is used for calculating the voltage data value Y_OUT. First, in the algorithm illustrated in FIG. 14, i-th midpoint calculation involves calculating the first order midpoints $d_{i-1}$, $e_{i-1}$ and the second order midpoint $f_{i-1}$ after the control points $A_{i-1}$, $B_{i-1}$ and $C_{i-1}$ are subjected to parallel displacement so that the point $B_{i-1}$ is shifted to the origin. Second, the second order midpoint $f_{i-1}$ is always selected as the point $C_i$ used in the (i+1)-th midpoint calculation. The repetition of such parallel displacement and midpoint calculation effectively reduces the number of required calculating units and the number of bits of the values processed by the respective calculating units. In the following, a detailed description is given of the algorithm illustrated in FIG. 14.

In the first parallel displacement and midpoint calculation, the control points $A_0$, $B_0$ and $C_0$ are subjected to parallel displacement so that the point $B_0$ is shifted to the origin. The control points $A_0$, $B_0$ and $C_0$ after the parallel displacement are denoted by $A_0'$, $B_0'$ and $C_0'$, respectively. The control point $B_0'$ coincides with the origin. Here, the coordinates of the control points $A_0'$ and $C_0'$ are represented as follows, respectively:

$$A_0'(AX_0',AY_0')=(AX_0-BX_0,AY_0-BY_0), \text{ and}$$

$$C_0'(CX_0',CY_0')=(CX_0-BX_0,CY_0-BY_0).$$

Concurrently, a parallel displacement distance $BX_0$ in the X axis direction is subtracted from a calculation target grayscale value $X_IN_0$ to obtain a calculation target grayscale value $X_IN_1$.

Next, the first order midpoint $d_0'$ of the control points $A_0'$ and $B_0'$ and the first order midpoint $e_0'$ of the control points $B_0'$ and $C_0'$ are calculated, and further the second order midpoint $f_0'$ of the first order midpoints $e_0'$ and $f_0'$ is calculated. The second order midpoint $f_0'$ is positioned on the second degree Bezier curve subjected to such parallel displacement that the control point $B_i$ is shifted to the origin (that is, the second degree Bezier curve specified by the three control points $A_0'$, $B_0'$ and $C_0'$).

In this case, the coordinates $(X_{f0}', Y_{f0}')$ of the second order midpoint $f_0'$ are represented by the following expression:

$$(X_{f0}', Y_{f0}') = \left(\frac{AX_0' + CX_0'}{4}, \frac{AY_0' + CY_0'}{4}\right), \quad (14)$$
$$= \left(\frac{(AX_0 - BX_0) + (CX_0 - BX_0)}{4}, \frac{(AY_0 - BY_0) + (CY_0 - BY_0)}{4}\right)$$
$$= \left(\frac{AX_0 - 2BX_0 + CX_0}{4}, \frac{AY_0 - 2BY_0 + CY_0}{4}\right)$$

The three control points $A_1$, $B_1$ and $C_1$ used in next parallel displacement and midpoint calculation (second parallel displacement and midpoint calculation) are selected from among the point $A_0'$, the first order midpoint $d_0'$, the second order midpoint $f_0'$, the first order midpoint $e_0'$ and the point $C_0'$ in response to the result of comparison of the calculation target grayscale value $X_IN_1$ with the X coordinate value $X_{f0}'$ of the second order midpoint $f_O'$. In this selection, the second order midpoint $f_O'$ is always selected as the point $C_1$ whereas the control points $A_1$ and $B_1$ are selected as follows:

$$\text{When } X_{f0}' \geq X_IN_1 \quad (A)$$

In this case, the two points having the least two X coordinates (the leftmost two points), that is, the control point $A_0'$ and the first order midpoint $d_0'$ are selected as the control points $A_1$ and $B_1$, respectively. In other words, $$A_1=A_0', B_1=d_0' \text{ and } C_1=f_0'. \quad (15a)$$

$$\text{When } X_{f0} < X_IN_1 \quad (B)$$

In this case, the two points having the largest two X coordinates (the rightmost two points), that is, the control point $C_0'$ and the first order midpoint $e_0'$ are selected as the control points $A_1$ and $B_1$, respectively. In other words, $$A_1=C_0', B_1=e_0' \text{ and } C_1=f_0'. \quad (15b)$$

As a whole, in the first parallel displacement and midpoint calculation, the following calculations are performed:

$$X_IN_1=X_IN_0-BX_0, \text{ and} \quad (16)$$

$$X_{f0}'=(AX_0-2BX_0+CX_0)/4. \quad (17)$$

$$\text{When } X_{f0}' \geq X_IN_1, \quad (A)$$

$$AX_1=AX_0-BX_0, \quad (17a)$$

$$BX_1=(AX_0-BX_0)/2, \quad (18a)$$

$$CX_1=X_{f0}'=(AX_0-2BX_0+CX_0)/4, \quad (19)$$

$$AY_1=AY_0-BY_0, \quad (20a)$$

$$BY_1=(AY_0-BY_0)/2, \text{ and} \quad (21a)$$

$$CY_1=Y_{f0}'= (AY_0-2BY_0+CY_0)/4. \quad (22)$$

$$\text{When } X_{f0}' < X_IN, \quad (B)$$

$$AX_1=CX_0-BX_0, \quad (17b)$$

$$BX_1=(CX_0-BX_0)/2, \quad (18b)$$

$$CX_1=(AY_0-2BY_0+CY_0)/4, \quad (19)$$

$$AY_1=CY_0-BY_0, \quad (20b)$$

$$BY_1=(CY_0-BY_0)/2, \text{ and} \tag{21b}$$

$$CY_1=(AY_0-2BY_0+CY_0)/4. \tag{22}$$

With respect to conditions (A) and (B), it would be obvious for a person skilled in the art that the equal sign may be attached to either the inequality sign recited in condition (A) or that in condition (B).

As understood from expressions (17a), (18a), (17b) and (18b), the following relationship is established irrespectively of which of conditions (A) and (B) is satisfied:

$$AX_1=2BX_1, \text{ and} \tag{23}$$

$$AY_1=2BY_1. \tag{24}$$

This implies that there is no need to redundantly calculate or store the coordinates of the control points $A_1$ and $B_1$ when the above-described calculations are actually implemented. This would be understood from the fact that the control point $B_1$ is located at the midpoint between the control point $A_1$ and the origin O as illustrated in FIG. 14. Although a description is given below of an embodiment in which the coordinates of the control point $B_1$ are calculated, the calculation of the coordinates of the control point $A_1$ is substantially equivalent to that of the coordinates of the control point $B_1$.

Similar operations are performed in the second parallel displacement and midpoint calculation. First, the control points $A_1$, $B_1$ and $C_1$ are subjected to such a parallel displacement that the point $B_1$ is shifted to the origin. The control points $A_1$, $B_1$ and $C_1$ after the parallel displacement are denoted by $A_1'$, $B_1'$ and $C_1'$, respectively. Additionally, the parallel displacement distance $BX_1$ in the X axis direction is subtracted from the calculation target grayscale value $X_IN_1$, thereby calculating the calculation target grayscale value $XIN_2$. Next, the first order midpoint $d_1'$ of the control points $A_1'$ and $B_1'$ and the first order midpoint $e_1'$ of the control points $B_1'$ and $C_1'$ are calculated, and further the second order midpoint $f_1'$ of the first order midpoints $d_1'$ and $e_1'$ is calculated.

Similarly to expressions (16) to (22), the following expressions are obtained:

$$X_IN_2=X_IN_1-BX_1, \text{ and} \tag{25}$$

$$X_{f1}'=(AX_1-2BX_1+CX_1)/4. \tag{26}$$

When $X_{f1}' \geq X_IN_2$, (A)

$$AX_2=AX_1-BX_1, \tag{27a}$$

$$BX_2=(AX_1-BX_1)/2, \tag{28a}$$

$$CX_2=X_{f1}',=(AX_1-2BX_1+CX_1)/4, \tag{29}$$

$$AY_2=AY_1-BY_1, \tag{30a}$$

$$BY_2=(AY_1-BY_1)/2, \text{ and} \tag{31a}$$

$$CY_2=Y_{f1}', \text{ and}$$

$$=(AY_1-2BY_1+CY_1)/4. \tag{32}$$

(*B*) When $X_{f1}' < X_IN_2$, $$AX_2=CX_1-BX_1, \tag{27b}$$

$$BX_2=(CX_1-BX_1)/2, \tag{28b}$$

$$CX_2=(AY_1-2BY_1+CY_1)/4, \tag{29}$$

$$AY_2=CY_1-BY_1, \tag{30b}$$

$$BY_2=(CY_1-BY_1)/2, \text{ and} \tag{31b}$$

$$CY_2=(AY_1-2BY_1+CY_1)/4. \tag{32}$$

Here, by substituting expression (23) into expressions (28a) and (29) and expression (24) into expressions (31a) and (32), the following expressions are obtained:

$$BX_2=BX_1/2, \text{ (for } CX_1 \geq X_IN_2) \tag{33a}$$

$$=(CX_1-BX_1)/2, \text{ (for } CX_1 < X_IN_2) \tag{33b}$$

$$CX_2=CX_1/4, \tag{34}$$

$$BY_2=BY_1/2, \text{ (for } CX_1 \geq X_IN_2) \tag{35a}$$

$$=(CY_1-BY_1)/2, \text{ (for } CX_1 \geq X_IN_2) \text{ and} \tag{35b}$$

$$CY_2=CY_1/4. \tag{36}$$

It should be noted that there is no need to redundantly calculate or store the X coordinate $AX_2$ and the Y coordinate $AY_2$ of the control point $A_2$, since the following relationship is established as is the case of expressions (23) and (24):

$$AX_2=2BX_2, \text{ and} \tag{37}$$

$$AY_2=2BY_2. \tag{38}$$

Similar calculations are performed in the third and subsequent parallel displacements and midpoint calculations. Similarly to the second parallel displacement and midpoint calculation, it would be understood that the calculations performed in the i-th parallel displacement and midpoint calculation (for i≥2) are represented by the following expressions:

$$X_IN_i = X_IN_{i-1} - BX_{i-1}, \tag{39}$$

$$BX_i = BX_{i-1}/2, \text{ (for } CX_{i-1} \geq X_IN_i) \tag{40a}$$

$$= (CX_{i-1} - BX_{i-1})/2, \text{ (for } CX_{i-1} < X_IN_i) \tag{40b}$$

$$CX_i = CX_{i-1}/4, \tag{41}$$

$$BY_i = BY_{i-1}/2, \text{ (for } CX_{i-1} \geq X_IN_i) \tag{42a}$$

$$= (CY_{i-1} - BY_{i-1})/2, \text{ (for } CX_{i-1} < X_IN_i) \text{ and} \tag{42b}$$

$$CY_i = CY_{i-4}/4. \tag{43}$$

With respect to expressions (40a) and (40b), it would be obvious for a person skilled in the art that the equal sign may be attached to either the inequality sign recited in expression (40a) or that in expression (40b). The same goes for expressions (42a) and (42b).

Here, expressions (41) and (43) imply that the control point $C_1$ is positioned on the segment connecting the origin O to the control point $C_{1-i}$ and that the distance between the control point $C_i$ and the origin O is a quarter of the length of the segment $OC_{i-1}$. That is, the repetition of the parallel displacement and midpoint calculation makes the control point $C_i$ closer to the origin O. It would be readily understood that such a relationship allows simplification of the calculation of coordinates of the control point $C_1$. It should be also noted that there is no need to calculate or store the coordinates of the points $A_2$ to $A_N$ in the second and following parallel displacements and midpoint calculations similarly to the first parallel displacement and midpoint calculation, since expressions (39) to (43) do not recite the coordinates of the control points $A_i$ and $A_{i-1}$.

The voltage data value Y_OUT to be finally obtained by repeating the parallel displacement and midpoint calculation N times is obtained as the Y coordinate value of the control point $B_N$ with all the parallel displacements cancelled (which is identical to the Y coordinate of the control point $B_N$ illustrated in FIG. 4). That is, the output coordinate value Y_OUT can be calculated the following expression:

$$Y_OUT=BY_0+BY_1+\ldots+BY_{i-1}. \quad (44)$$

Such an operation can be achieved by performing the following operation in the i-th parallel displacement and midpoint calculation:

$$Y_OUT_1=BY_0, \text{ (for } i=1\text{) and}$$

$$Y_OUT_i=Y_OUT_{i-1}+BY_{i-1}. \text{ (for } i\geq 2\text{)} \quad (45)$$

In this case, the voltage data value Y_OUT of interest is obtained as $Y_OUT_N$.

Figure 15:
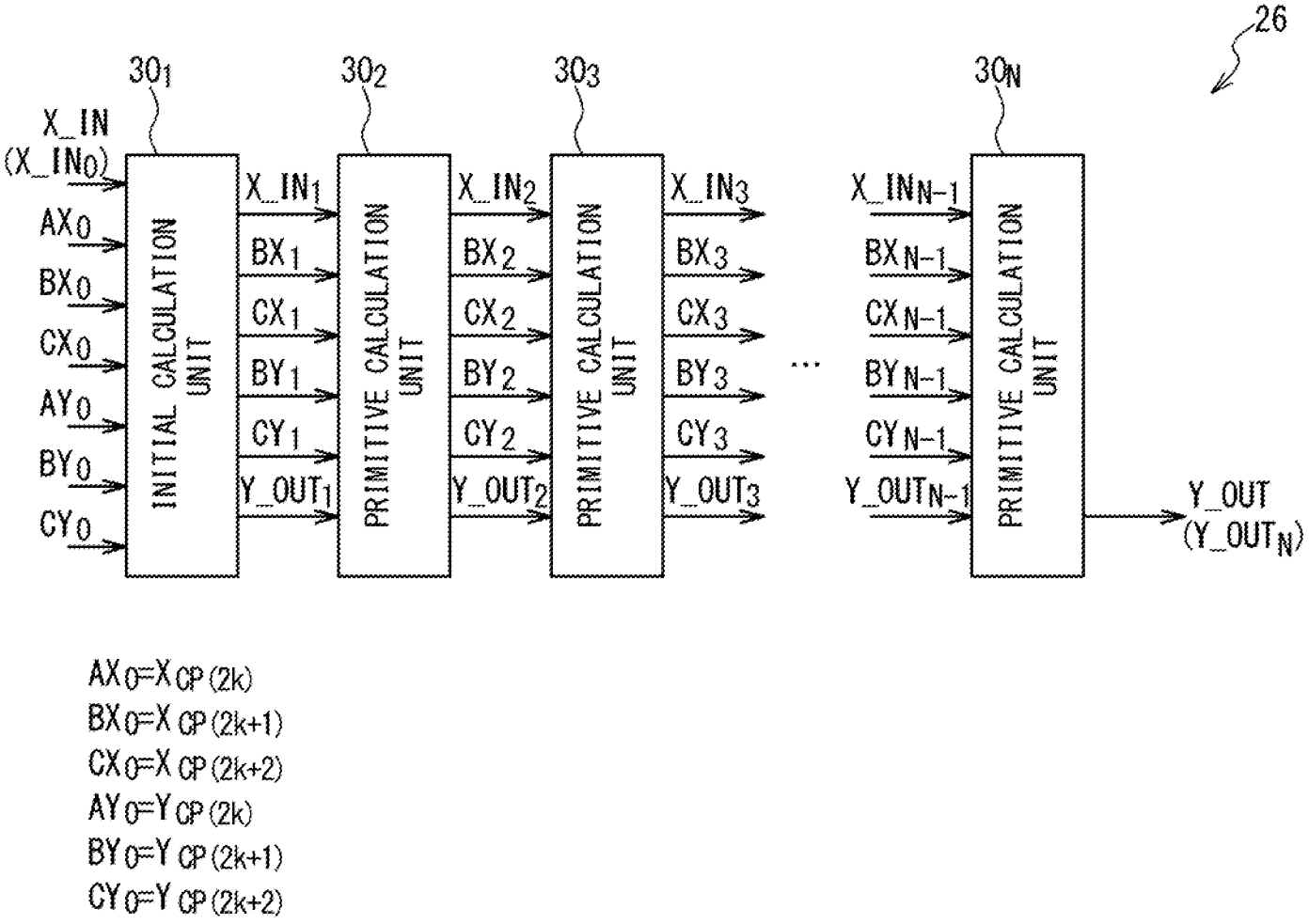
FIG. 15 is a block diagram illustrating the configuration of the Bezier calculation circuit for implementing parallel displacement and midpoint calculation with hardware.

FIG. 15 is a circuit diagram illustrating the configuration of the Bezier calculation circuit 26 in which the parallel displacement and midpoint calculation described above are implemented with hardware. The Bezier calculation circuit 26 illustrated in FIG. 15 includes an initial calculation unit $\mathbf{50}_1$ and a plurality of primitive calculation units $\mathbf{50}_2$ to $\mathbf{50}_N$ serially connected to the output of the initial calculation unit $\mathbf{50}_1$. The initial calculation unit $\mathbf{50}_1$ has the function of achieving the first parallel displacement and midpoint calculation and is configured to perform the calculations in accordance with expressions (16) to (22). The primitive calculation units $\mathbf{50}_2$ to $\mathbf{50}_N$ have the function of achieving the second and following parallel displacements and midpoint calculations and are configured to perform the calculations in accordance with expressions (39) to (43) and (45).

Figure 16:
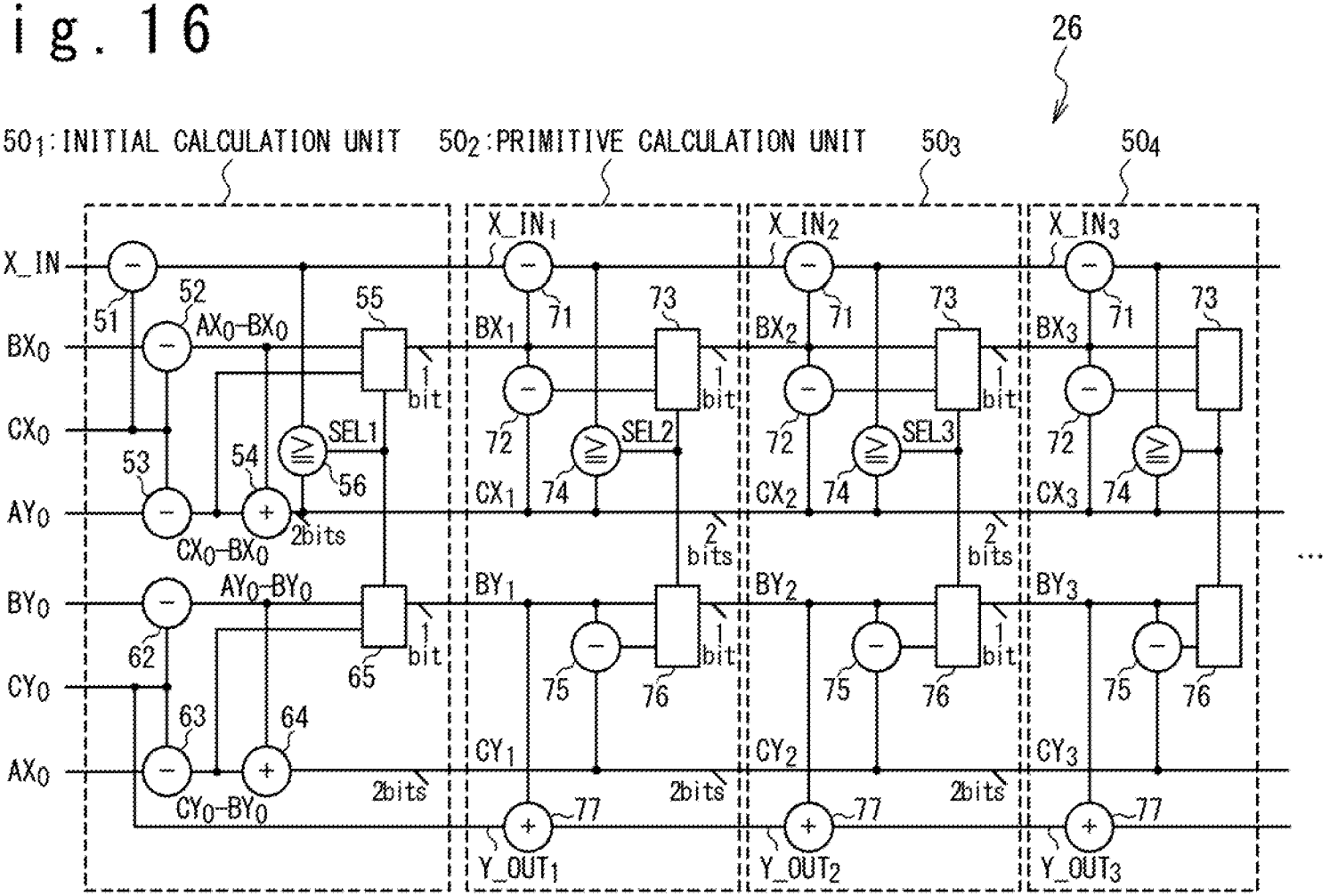
FIG. 16 is a circuit diagram illustrating the configurations of an initial calculation unit and primitive calculation units.

FIG. 16 is a circuit diagram illustrating the configurations of the initial calculation unit $\mathbf{50}_1$ and the primitive calculation units $\mathbf{50}_2$ to $\mathbf{50}_N$. The initial calculation unit $\mathbf{50}_1$ includes subtractors 51 to 53, an adder 54, a selector 55, a comparator 56, subtractors 62 and 63, an adder 64, and a selector 65. The initial calculation unit $\mathbf{50}_1$ has seven input terminals; the input grayscale value X_IN is inputted to one of the input terminals, and the X coordinates $AX_O$, $BX_O$ and $CX_O$ and Y coordinates $AY_O$, $BY_O$, and $CY_O$ of the control points $A_O$, $B_O$ and $C_O$ are supplied to the other six terminals, respectively.

The subtracter 51 has a first input to which the input grayscale value X_IN is supplied and a second input connected to the input terminal to which $BX_O$ is supplied. The subtracter 52 has a first input connected to the input terminal to which $AX_O$ is supplied and a second input connected to the input terminal to which $BX_O$ is supplied. The subtracter 53 has a first input connected to the input terminal to which $CX_O$ is supplied and a second input connected to the input terminal to which $BX_O$ is supplied. The adder 54 has a first input connected to the output of the subtracter 52 and a second input connected to the output of the subtracter 53.

Similarly, the subtracter 62 has a first input connected to the input terminal to which $AY_O$ is supplied and a second input connected to the input terminal to which $BY_O$ is supplied. The subtracter 63 has a first input connected to the input terminal to which $CY_O$ is supplied and a second input connected to the input terminal to which $BY_O$ is supplied. The adder 64 has a first input connected to the output of the subtracter 62 and a second input connected to the output of the subtracter 63.

The comparator 56 has a first input connected to the output of the subtracter 51 and a second input connected to the output of the adder 54. The selector 55 has a first input connected to the output of the subtracter 52 and a second input connected to the output of the subtracter 53, and selects the first or second input in response to the output value SEL1 of the comparator 56. Furthermore, the selector 65 has a first input connected to the subtracter 62 and a second input connected to the output of the subtracter 63, and selects the first or second input in response to the output value SEL1 of the comparator 56.

The output terminal from which the calculation target grayscale value $X_IN_1$ is outputted is connected to the output of the subtracter 51. Further, the output terminal from which $BX_1$ is outputted is connected to the output of the selector 55, and the output terminal from which $CX_1$ is outputted is connected to the output of the adder 54. Furthermore, the output terminal from which $BY_1$ is outputted is connected to the output of the selector 65, and the output terminal thereof from which $CY_1$ is outputted is connected to the output of the adder 64.

The subtracter 51 performs the calculation in accordance with expression (16), and the subtracter 52 performs the calculation in accordance with expression (18a). The subtracter 53 performs the calculation in accordance with expression (18b), and the adder 54 performs the calculation in accordance with expression (19) on the basis of the output values of the subtractors 52 and 53. Similarly, the subtracter 62 performs the calculation in accordance with expression (21a). The subtracter 63 performs the calculation in accordance with expression (21b), and the adder 64 performs the calculation in accordance with expression (22) on the basis of the output values of the subtractors 62 and 63. The comparator 56 compares the output value of the subtracter 51 (that is, $X_IN_O-BX_0$) with the output value of the adder 54, and instructs the selectors 55 and 65 to select which of the two input values thereof is to be outputted as the output value. When $X_IN_1$ is equal to or smaller than $(AX_O-2BX_O+CX_O)/4$, the selector 55 selects the output value of the subtracter 52 and the selector 65 selects the output value of the subtracter 62. When $X_IN_O-BX_O$ is larger than $(AX_O-2BX_O+CX_O)/4$, the selector 55 selects the output value of the subtracter 53 and the selector 65 selects the output value of the subtracter 63. The values selected by the selectors 55 and 65 are supplied to the primitive calculation unit $\mathbf{50}_2$ as $BX_1$ and $BY_1$, respectively. Furthermore, the output values of the adders 54 and 64 are supplied to the primitive calculation unit $\mathbf{50}_2$ as $CX_1$ and $CY_1$, respectively.

It should be noted here that divisions recited in expressions (16) to (22) can be realized by truncating lower bits. The positions where the lower bits are truncated in the circuit may be arbitrarily modified as long as calculations equivalent to expressions (16) to (22) are performed. The initial calculation unit $\mathbf{50}_1$ illustrated in FIG. 16 is configured to truncate the lowest one bit on the outputs of the selectors 55 and 65 and to truncate the lowest two bits on the outputs of the adders 54 and 64.

Meanwhile, the primitive calculation units $\mathbf{50}_2$ to $\mathbf{50}_N$, which have the same configuration, each include subtractors 71 and 72, a selector 73, a comparator 74, a subtracter 75, a selector 76, and an adder 77.

In the following, a description is given of the primitive calculation unit $\mathbf{50}_i$ which performs the i-th parallel displacement and midpoint calculation, where i is an integer from two to N. The subtracter 71 has a first input connected to the input terminal to which the calculation target grayscale value $X_IN_{i-1}$ is supplied, and a second input connected to the input terminal to which $BX_{i-1}$ is supplied. The subtracter 72 has a first input connected to the input terminal to which $BX_{i-1}$ is supplied, and a second input connected to the input terminal to which $CX_{i-1}$ is supplied. The subtracter 75 has a first input connected to the input terminal to which $BY_{i-1}$ is supplied, and a second input connected to the input terminal to which $CY_{i-1}$ is supplied.

The comparator 74 has a first input connected to the output of the subtracter 71 and a second input connected to the input terminal to which $CX_{i-1}$ is supplied.

The selector 73 has a first input connected to the input terminal to which $BX_{i-1}$ is supplied, and a second input connected to the output of the subtracter 72, and selects the first or second input in response to the output value SELi of the comparator 74. Similarly, the selector 76 has a first input connected to the input terminal to which $BY_{i-1}$ is supplied, and a second input connected to the output of the subtracter 75, and selects the first or second input in response to the output value of the comparator 74.

The calculation target grayscale value $X_IN_i$ is output from the output terminal connected to the output of the subtracter 71. $BX_i$ is output from the output terminal connected to the output of the selector 73, and $CX_i$ is output from the output terminal connected to the input terminal to which $CX_i$ is supplied via an interconnection. In this process, the lower two bits of $CX_i$ are truncated. Furthermore, $BY_i$ is output from the output terminal connected to the output of the selector 73, and $CY_i$ is output from the output terminal connected to the input terminal to which $CY_{i-1}$ is supplied via an interconnection. In this process, the lower two bits of $CY_{i-1}$ are truncated.

Meanwhile, the adder 77 has a first input connected to the input terminal to which $BX_{i-1}$ is supplied, and a second input connected to the input terminal to which $Y_OUT_{i-1}$ is supplied. It should be noted that, with respect to the primitive calculation unit $\mathbf{50}_2$ which performs the second parallel displacement and midpoint calculation, the $Y_OUT_1$ supplied to the primitive calculation unit $\mathbf{50}_2$ coincides with $BY_O$. $Y_OUT_i$ is outputted from the output of the adder 77.

The subtracter 71 performs the calculation in accordance with expression (39), and the subtracter 72 performs the calculation in accordance with expression (40b). The subtracter 75 performs the calculation in accordance with expression (42b), and the adder 77 performs the calculation in accordance with expression (45). The comparator 74 compares the output value $X_IN_i$ ($=X_IN_{i-1}-BX_{i-1}$) of the subtracter 71 with $CX_{i-1}$, and instructs the selectors 73 and 76 to select which of the two input values thereof is to be outputted as the output value. When $X_IN_i$ is equal to or smaller than $CX_{i-1}$, the selector 73 selects $BX_{i-1}$ and the selector 76 selects $BY_{i-1}$. When $X_IN_i$ is larger than $CX_{i-1}$, on the other hand, the selector 73 selects the output value of the subtracter 72 and the selector 76 selects the output value of the subtracter 75. The values selected by the selectors 73 and 76 are supplied to the next primitive calculation unit $\mathbf{50}_{i+1}$ as $BX_i$ and $BY_i$, respectively. Furthermore, the values obtained by truncating the lower two bits of $CX_{i-1}$ and $CY_{i-1}$ are supplied to the next primitive calculation unit $\mathbf{50}_{i+1}$ as $CX_i$ and $CY_1$, respectively.

It should be noted here that divisions recited in expressions (40) to (43) can be realized by truncating lower bits. The positions where the lower bits are truncated in the circuit may be arbitrarily modified as long as operations equivalent to Equations (40) to (43) are performed. The primitive calculation unit $\mathbf{50}_i$ illustrated in FIG. 16 is configured to truncate the lower one bit on the outputs of the selectors 73 and 76 and to truncate the lower two bits on the interconnections receiving $CX_{i-1}$ and $CY_{i-1}$.

The effect of reduction in the number of the calculating units would be understood from the comparison of the configuration of the primitive calculation units $\mathbf{50}_2$ to $\mathbf{50}_N$ illustrated in FIG. 16 with that of the primitive calculation units $\mathbf{30}_1$ to $\mathbf{30}_N$ illustrated in FIG. 13. Besides, in the configuration adapted to the parallel displacement and midpoint calculation as illustrated in FIG. 16, in which each of the primitive calculation units $\mathbf{50}_2$ to $\mathbf{50}_N$ is configured to truncate lower bits, the number of bits of data to be handled is more reduced in latter ones of the primitive calculation units $\mathbf{50}_2$ to $\mathbf{50}_N$. As thus discussed, the configuration adapted to the parallel displacement and midpoint calculation as illustrated in FIG. 16 allows calculating the voltage data value Y_OUT with reduced hardware utilization.

Although the above-described embodiments recite the cases in which the voltage data value Y_OUT is calculated using the second degree Bezier curve having the shape specified by three control points, the voltage data value Y_OUT may be calculated by using a third or higher degree Bezier curve, alternatively. When an $n^{th}$ degree Bezier curve is used, the X and Y coordinates of (n+1) control points are initially given, and similar midpoint calculations are performed on the (n+1) control points to calculate the voltage data value Y_OUT.

More specifically, when (n+1) control points are given, the midpoint calculation is performed as follows: First order midpoints are each calculated as a midpoint of adjacent two of the (n+1) control points. The number of the first order midpoints is n. Further, second order midpoints are each calculated as a midpoint of adjacent two of the n first order midpoints. The number of the second order midpoint is n−1. In the same way, (n−k) (k+1)-th order midpoints are each calculated as a midpoint of adjacent two of the (n−k+1) k-th order midpoints. This procedure is repeatedly carried out until the single n-th order midpoint is finally calculated. Here, the control point having the smallest X coordinate out of the (n+1) control points is referred to as the minimum control point and the control point having the largest X coordinate is referred to as the maximum control point. Similarly, the k-th order midpoint having the smallest X coordinate out of the k-th order midpoints is referred to as the k-th order minimum midpoint and the k-th order midpoint having the largest X coordinate is referred to as the k-th order maximum midpoint. When the X coordinate value of the n-th order midpoint is smaller than the input grayscale value X_IN, the minimum control point, the first to (n−1)-th order minimum midpoints and the n-th order midpoint are selected as the (n+1) control points for the next step. When the X coordinate of the n-th order midpoint is larger than the input grayscale value X_IN, the n-th order midpoint, the first to (n−1)-th order maximum midpoints and the maximum control point are selected as the (n+1) control points for the next midpoint calculation. The voltage data value Y_OUT is calculated on the basis of the Y coordinate of at least one of the (n+1) control points obtained through n times of the midpoint calculation.

For easy understanding of such generalization, a description is given below of midpoint calculation for the case when n=3 (that is, the case when a third degree Bezier curve is used to calculate the voltage data value Y_OUT). In this case, four control points CP(3*k*) to CP(3*k*+3) are set to the Bezier calculation circuit 26. In the following, the four control points CP(3*k*) to CP(3*k*+3) are simply referred to control points $A_0$, $B_0$, $C_0$ and $D_0$ and the coordinates of the control points $A_O$, $B_O$, $C_O$, and $D_O$ are referred to as ($AX_O$, $AY_O$), ($BX_O$, $BY_E$)), ($CX_O$, $CY_O$), and ($DX_O$, $DY_O$)), respectively. The coordinates $A_0(AX_0, AY_0)$, $B_0(BX_0, BY_0)$, $C_0$ ($CX_0$, $CY_0$) and $D_0$ ($DX_0$, $DY_0$) of the control points $A_O$, $B_O$, $C_O$, and $D_O$ are respectively represented as follows:

$$A_0(AX_0,AY_0)=(X_{CP(3k)},Y_{CP(3k)}), \quad (46a)$$

$$B_0(BX_0,BY_0)=(X_{CP(3k+1)},Y_{CP(3k+1)}), \quad (46b)$$

$$C_0(CX_0,CY_0)=(X_{CP(3k+2)},Y_{CP(3k+2)}), \text{ and} \quad (46c)$$

$$D_0(DX_0,DY_0)=(X_{CP(3k+3)},Y_{CP(3k+3)}). \quad (46d)$$

Figure 17:
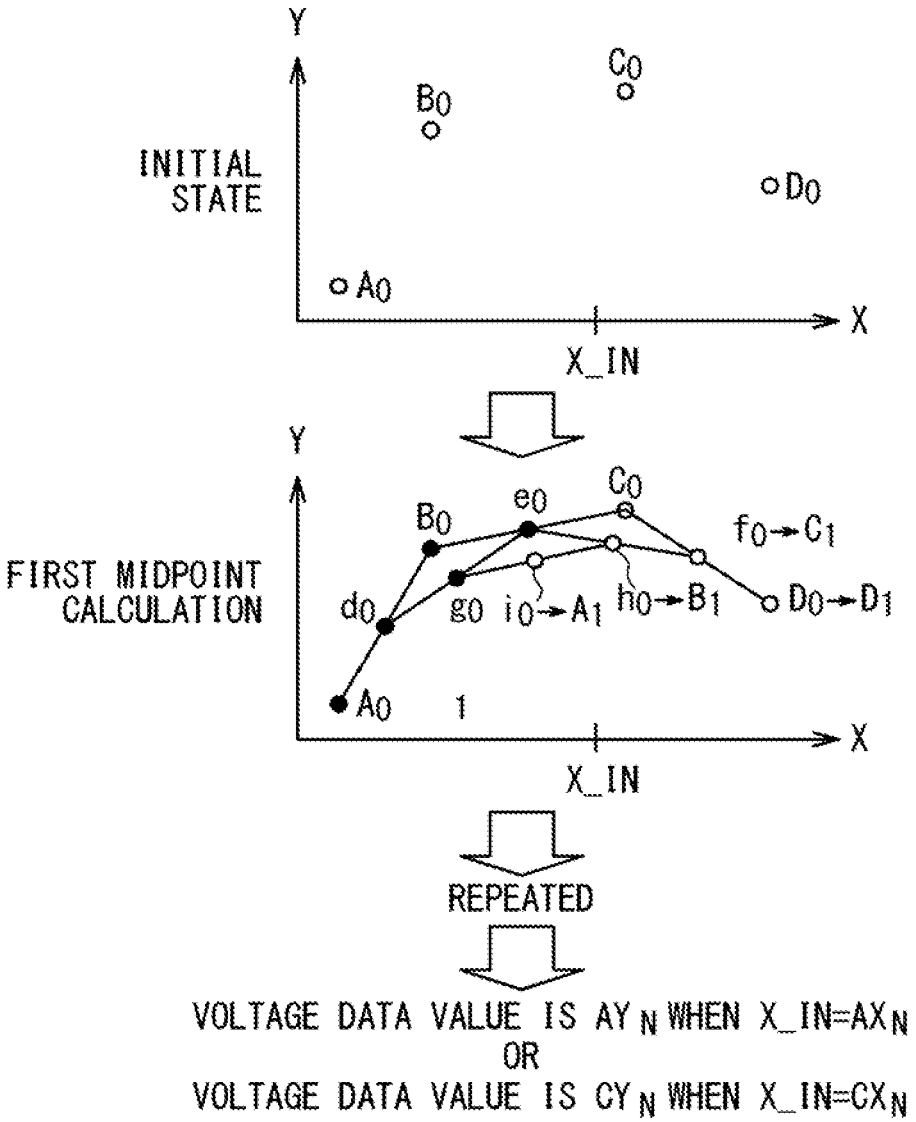
FIG. 17 is a diagram illustrating the midpoint calculation when n=3 (that is, when a third degree Bezier curve is used to calculate the voltage data value)

FIG. 17 is a diagram illustrating the midpoint calculation for n=3 (that is, for the case when the third degree Bezier curve is used to calculate the voltage data value Y_OUT). Initially, four control points $A_O$, $B_O$, $C_O$, and $D_O$ are given. It should be noted that the control point $A_O$ is the minimum control point and the point $D_O$ is the maximum control point. In the first midpoint calculation, the first order midpoint $d_O$ that is the midpoint of the control points $A_O$ and $B_O$, the first order midpoint $e_O$ that is the midpoint of the control points $B_O$ and $C_O$, and the first order midpoint $f_O$ that is the midpoint of the control points $C_O$ and $D_O$ are calculated. It should be noted that $d_O$ is the first order minimum midpoint and that $f_O$ is the first order maximum midpoint. Further, the second order midpoint $g_O$ that is the midpoint of the first order midpoints $d_O$ and $e_O$ and the second order midpoint $h_O$ that is the midpoint of the first order midpoints $e_O$ and $f_O$ are calculated. Here, the midpoint $g_O$ is the second order minimum midpoint and $h_O$ is the second order maximum midpoint. Furthermore, the third order midpoint $i_O$ that is the midpoint between the second order midpoints $g_O$ and $h_O$ is calculated. The third order midpoint $i_O$ is a point on the third degree Bezier curve specified by the four control points $A_O$, $B_O$, $C_O$ and $D_O$ and the coordinates ($X_{iO}$, $Y_{iO}$) of the third order midpoint $i_O$ are represented by the following equations, respectively:

$$X_{i0}=(AX_0+3BX_0+3CX_0+DX_0)/8, \text{ and}$$

$$Y_{i0}=(AY_0+3BY_0+3CY_0+DY_0)/8.$$

The four control points: points $A_1$, $B_1$, $C_1$ and $D_1$ used in the next midpoint calculation (the second midpoint calculation) are selected according to the result of comparison of the input grayscale value X_IN with the X coordinate $X_{iO}$ of the third-order midpoint $i_O$. More specifically, when $X_{iO} \geq$ X_IN, the minimum control point $A_O$, the first order minimum midpoint $d_O$, the second order minimum midpoint $f_O$, and the third order midpoint $e_O$ are selected as the control points $A_1$, $B_1$, $C_1$ and $D_1$, respectively. When $X_{iO}<$ X_IN, on the other hand, the third order midpoint $e_O$, the second order maximum midpoint $h_O$, the first order maximum midpoint $f_O$, and the maximum control point $D_O$ are selected as the points $A_1$, $B_1$, $C_1$ and $D_1$, respectively.

The second and subsequent midpoint calculations are performed by the similar procedure. Generally, the following calculations are performed in the i-th midpoint calculation:

(*A*) When $(AX_{i-1}+3BX_{i-1}+3CX_{i-1}+DX_{i-1})/8 \geq X_IN$, $$AX_i=AX_{i-1}, \quad (47a)$$

$$BX_i=(AX_{i-1}+BX_{i-1})/2, \quad (48a)$$

$$CX_i=(AX_{i-1}+2BX_{i-1}+CX_{i-1})/4, \quad (49a)$$

$$DX_i=(AX_{i-1}+3BX_{i-1}+3CX_{i-1}+DX_{i-1})/8, \quad (50a)$$

$$AY_i=AY_{i-1}, \quad (51a)$$

$$BY_i=(AY_{i-1}+BY_{i-1})/2, \quad (52a)$$

$$CY_i=(AY_{i-1}+2BY_{i-1}+3CY_{i-1})/4, \text{ and} \quad (53a)$$

$$DY_i=(AY_{i-1}+3BY_{i-1}+3CY_{i-1}+DY_{i-1})/8. \quad (54a)$$

(*B*) When $(AX_{i-1}+3BX_{i-1}+3CX_{i-1}+DX_{i-1})/8 < X_IN$, $$AX_i=(AX_{i-1}+3BX_{i-1}+3CX_{i-1}+DX_{i-1})/8, \quad (47b)$$

$$BX_i=(BX_{i-1}+2CX_{i-1}+DX_{i-1})/4, \quad (48b)$$

$$CX_i=(CX_{i-1}+DX_{i-1})/2, \quad (49b)$$

$$DX_i=DX_{i-1}, \quad (50b)$$

$$AX_1=(AX_{i-1}+3BX_{i-1}+3CX_{i-1}+DX_{i-1})/8 \quad (51b)$$

$$BY_i=(BY_{i-1}+2CY_{i-1}+DY_{i-1})/4, \quad (52b)$$

$$CY_i=(CY_{i-1}+DY_{i-1})/2, \text{ and} \quad (53b)$$

$$DY_1=DY_{i-1}. \quad (54b)$$

It would be obvious for a person skilled in the art that the equal sign may be attached to either the inequality sign recited in condition (A) or that in condition (B).

Each midpoint calculation makes the control points $A_i$, $B_i$, $C_i$ and $D_i$ closer to the third degree Bezier curve and also makes the X coordinate values of the control points $A_i$, $B_i$, $C_i$ and $D_i$ closer to the input grayscale value X_IN. The voltage data value Y_OUT to be finally calculated is obtained from the Y coordinate of at least one of the control points $A_N$, $B_N$, $C_N$ and $D_N$ obtained by the N-th midpoint calculation. For example, the voltage data value Y_OUT may be determined as the Y coordinate of an arbitrarily-selected one of the control points $A_N$, $B_N$, $C_N$ and $D_N$. Alternatively, the voltage data value Y_OUT may be determined as the average value of the Y coordinates of the control points $A_N$, $B_N$, $C_N$ and $D_N$.

In a range in which the number of times N of the midpoint calculations is relatively small, the preciseness of the voltage data value Y_OUT is more improved as the number of times N of the midpoint calculations is increased. It should be noted however that, once the number of times N of the midpoint calculations reaches the number of bits of the voltage data value Y_OUT, the preciseness of the voltage data value Y_OUT is not further improved thereafter. It is preferable that the number of times N of the midpoint calculations is equal to the number of bits of the voltage data value Y_OUT. In the present embodiment, in which the voltage data value Y_OUT is a 10-bit data, it is preferable that the number of times N of the midpoint calculations is 10.

Also when the voltage data value Y_OUT is calculated by using an $n^{th}$ degree Bezier curve, the midpoint calculation may be performed after performing parallel displacement on the control points so that one of the control points is shifted to the origin O similarly to the case when the second-order Bezier curve is used. When the gamma curve is expressed by a third degree Bezier curve, for example, the first to n-th order midpoints are calculated after subjecting the control points to parallel displacement so that the control point $B_{i-1}$ or $C_{i-1}$ is shifted to the origin O. Further, either a combination of the control point $A_{i-1'}$ obtained by the parallel displacement, the first order minimum midpoint, the second order minimum midpoint and the third order midpoint or a combination of the third order midpoint, the second order maximum midpoint, the first order maximum midpoint, and the control point $D_{i-1'}$ are selected as the next control points $A_i$, $B_i$, $C_i$ and $D_i$. Also in this case, the number of bits of values processed by each calculating unit is effectively reduced.

Second Embodiment

In driving a self-light emitting display panel such as an OLED (organic light emitting diode) display panel, it is desirable to perform data processing to control the brightness of the screen in the generation of the voltage data $D_{VOUT}$. In general, a display device is required to have the function of controlling the brightness of the screen (that is, the entire brightness of the displayed image). For example, it is preferable that a display device has the function of increasing the brightness of the screen in response to a manual operation, when the user desires to display a brighter image. As for a display device which has a backlight, such as a liquid crystal display panel, data processing for controlling the brightness of the screen is not necessary, because the brightness of the screen is controllable with the brightness of the backlight. In driving a self-emitting display panel such as an OLED display panel, on the other hand, it is preferable to perform data processing to generate voltage data $D_{VOUT}$ in response to a desired brightness level of the screen in controlling the drive voltage supplied to each subpixel of each pixel.

Figure 18:
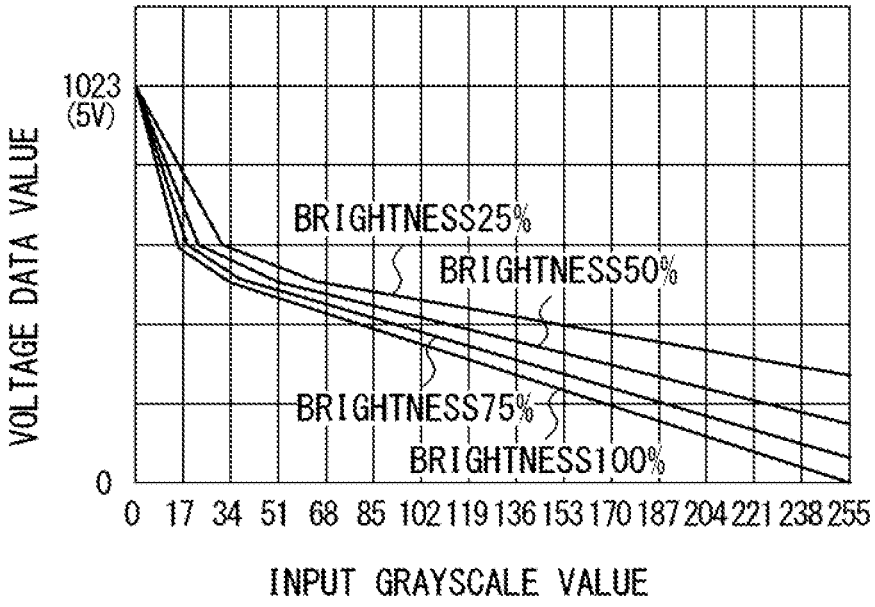
FIG. 18 is a graph illustrating one example of the correspondence relationship between the input grayscale value and the voltage data value, which is specified for each brightness level of the screen.

When processing to control the brightness of the screen is performed in generating the voltage data $D_{VOUT}$, it is preferable that the correspondence relationship between the input grayscale value X_IN and the voltage data value Y_OUT is modified depending on the brightness of the screen. FIG. 18 is graph illustrating one example of the correspondence relationship between the input grayscale value X_IN and the voltage data value Y_OUT defined for each brightness level of the screen. It should be noted that FIG. 18 illustrates the correspondence relationship between the input grayscale value X_IN and the voltage data value Y_OUT defined for each brightness level for the case when the OLED display panel id driven with voltage programming. In FIG. 18, the graph of the input-output characteristics is presented with an assumption that the voltage data value Y_OUT is 10 bits and each subpixel of each pixel of the OLED display panel is programmed with a voltage proportional to the voltage data value Y_OUT. When the voltage data value Y_OUT is "1023", for example, the target subpixel is programmed with a voltage of 5V.

Presented in the embodiment described below is a display device configured to allow modifying the correspondence relationship between the input grayscale value X_IN and the voltage data value Y_OUT depending on the brightness of the screen through processing on control point data, as illustrated in FIG. 18.

Figure 19:
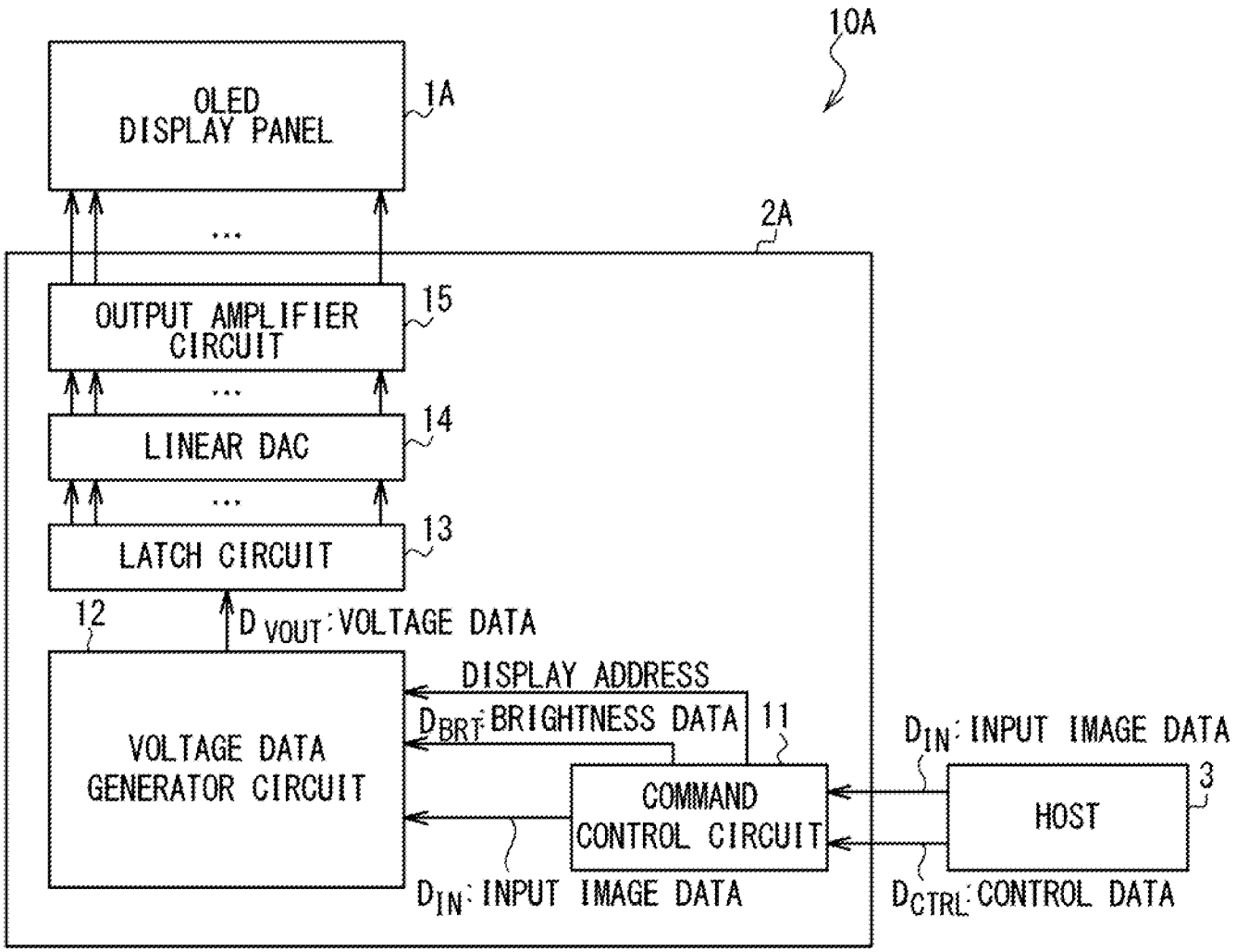
FIG. 19 is a block diagram illustrating the configuration of a display device in a second embodiment.

FIG. 19 is a block diagram illustrating the configuration of a display device 10A in a second embodiment. The display device 10A of the second embodiment is configured as an OLED display device including an OLED display panel 1A and a display driver 2A. The OLED display panel 1A is configured as illustrated in FIG. 4; however, each pixel circuit 6 includes a current-driven element, more specifically, an OLED element. The display driver 2A drives the OLED display panel 1A in response to the input image data $D_{IN}$ and control data $D_{CTRL}$ received from the host 3, to display images on the OLED display panel 1A.

The configuration of the display driver 2A of the second embodiment is almost similar to that of the display driver 2 of the first embodiment. It should be noted however that the display driver 2A of the second embodiment includes a voltage data generator circuit 12A configured differently from the voltage data generator circuit 12 of the first embodiment. Additionally, the command control circuit 11 supplies a brightness data which specifies the brightness level of the display screen of the OLED display panel 1A (that is, the entire brightness of the image displayed on the OLED display panel 1A). In one embodiment, the control data $D_{CTRL}$ received from the host 3 may include brightness data $D_{BRT}$ and the command control circuit 11 may supply the brightness data $D_{BRT}$ included in the control data $D_{CTRL}$ to the voltage data generator circuit 12A.

Figure 20:
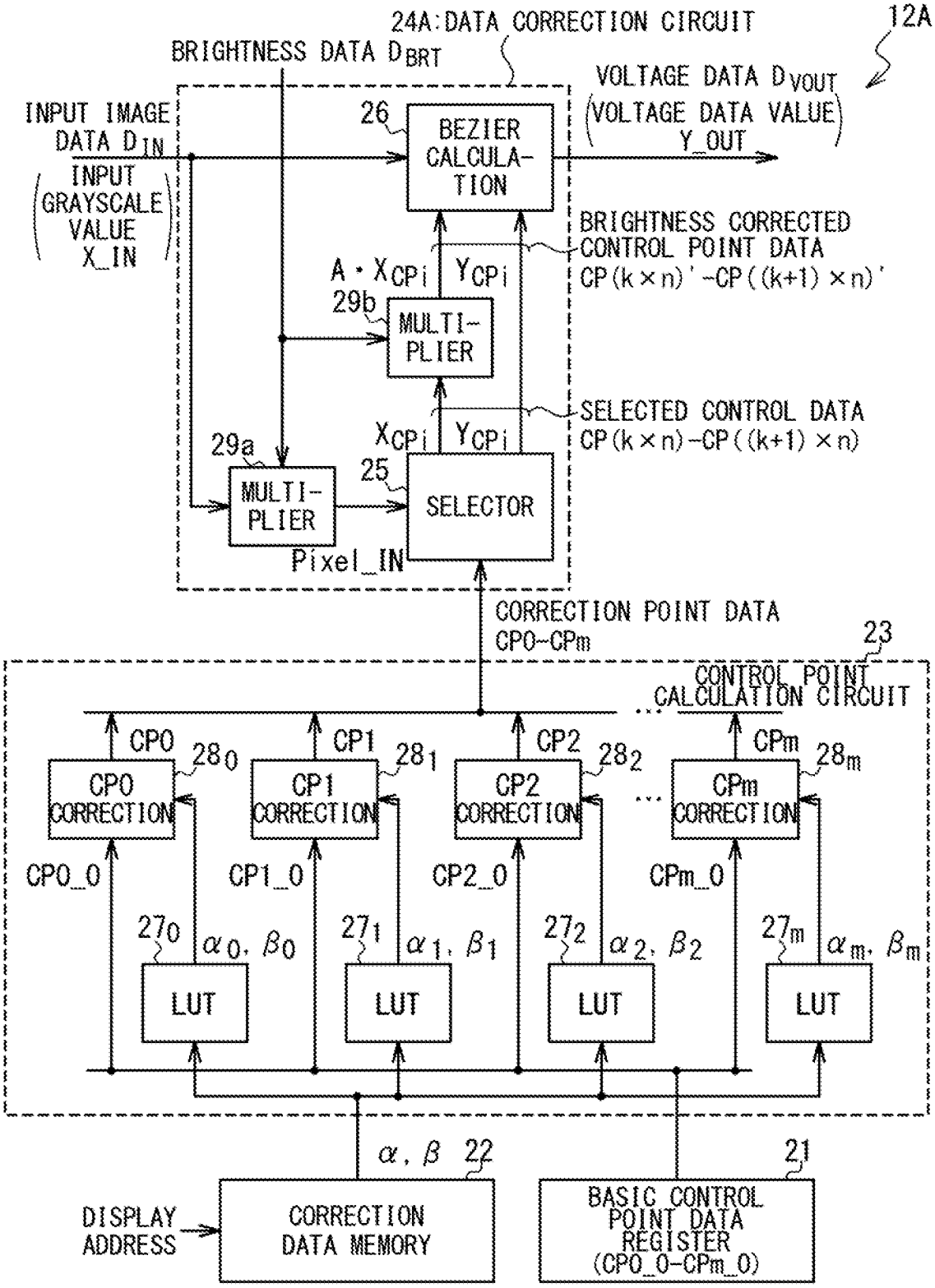
FIG. 20 is a block diagram illustrating the configuration of the voltage data generator circuit in the second embodiment.

FIG. 20 is a block diagram illustrating the configuration of the voltage data generator circuit 12A in the second embodiment. The configuration of the voltage data generator circuit 12A in the second embodiment is almost similar to that of the voltage data generator circuit 12 used in the first embodiment. Here, the coordinates of the basic control points CP0_0 to CPm_0 which specify the correspondence relationship between the input grayscale value X_IN and the voltage data value Y_OUT for the allowed maximum brightness level of the screen are described as the basic control point data CP0_0 to CPm_0.

It should be noted here that the configuration of the data correction circuit 24A is modified in the second embodiment. The data correction circuit 24A used in the second embodiment includes multiplier circuits 29*a* and 29*b*, in addition to the selector 25 and the Bezier calculation circuit 26.

The multiplier circuit 29*a* outputs the value obtained by multiplying the input grayscale value X_IN by 1/A as the control-point-selecting grayscale value Pixel_IN. Note that a detail description will be given of the value A.

The selector 25 selects selected control point data CP(k×n) to CP((k+1)×n) corresponding to (n+1) control points from among the control point data CP0 to CPm, on the basis of the control-point-selecting grayscale value Pixel_IN. The selected control point data CP(k×n) to CP((k+1)×n) are selected to satisfy the following expression (55):

$$X_{CP(k\times n)} \leq \text{Pixel_IN} \leq X_{CP((k+1)\times n)}. \tag{55}$$

The multiplier circuit 29*b* is used to obtain brightness-corrected control point data CP(k×n)' to CP((k+1)×n)' in response to the brightness data $D_{BRT}$ from the selected control data CP(k×n) to CP((k+1)×n). Note that the brightness-corrected control point data CP(k×n)' to CP((k+1)×n)' are data indicating the coordinates of the brightness-corrected control points CP(k×n)' to CP((k+1)×n)' used to calculate the voltage data value Y_OUT from the input grayscale value X_IN in the Bezier calculation circuit 26. The multiplier circuit 29*b* calculates the X coordinates of the respective brightness-corrected control points CP(k×n)' to CP((k+1)×n)' by multiplying the X coordinates $X_{CP0}$ to $X_{CPm}$ of the selected coordinates CP(k×n) to CP((k+1)×n) by A. The Y coordinates of the brightness-corrected control points CP(k×n)' to CP((k+1)×n)' are equal to the Y coordinates of the selected control points CP(k×n) to CP((k+1)×n), respectively. In other words, the coordinates CPi'($X_{CPi}$', $Y_{CPi}$') of the brightness-corrected control point CPi' are obtained on the basis of the coordinates CPi($X_{CPi}$, $Y_{CPi}$) of the selected control point CPi by using the following expressions (56a) and (56b):

$$X_{CPi}' = A \cdot X_{CPi}, \text{ and} \tag{56a}$$

$$Y_{CPi}' = Y_{CPi}. \tag{56b}$$

The Bezier calculation circuit 26 calculates the voltage data value Y_OUT corresponding to the input grayscale value X_IN on the basis of the brightness-corrected control data CP(k×n)' to CP((k+1)×n)'. The voltage data value Y_OUT is calculated as the Y coordinate of the point which is positioned on the $n^{th}$ degree Bezier curve specified by the (n+1) brightness-corrected control points CP(k×n)' to CP((k+1)×n)' described in the brightness-corrected control point data CP(k×n)' to CP((k+1)×n)' and has an X coordinate equal to the input grayscale value X_IN.

Next, a description is given of the operation of the data correction circuit 24A in the second embodiment. The following description is given with an assumption that, when an input grayscale value X_IN of the subpixel of interest is given to the input of the data correction circuit 24A as the input image data $D_{IN}$, the data correction circuit 24A outputs the voltage data value Y_OUT as the data value of the voltage data $D_{VOUT}$ corresponding to the subpixel of interest. In the following description of the present embodiment, it is assumed that the input grayscale value X_IN is an eight-bit data and the voltage data value Y_OUT is a 10-bit data.

As described above, in the present embodiment, the correspondence relationship between the input grayscale value X_IN and the voltage data value Y_OUT is controlled on the brightness data $D_{BRT}$ in addition to the control point data CP0 to CPm, in the calculation of the voltage data value Y_OUT performed in the data correction circuit 24A. In detail, the selected control point data CP(k×n) to CP((k+1)×n) are selected from the control point data CP0 to CPm, and the brightness-corrected control point data CP(k×n)' to CP((k+1)×n)' are calculated from the selected control point data CP(k×n) to CP((k+1)×n) and the brightness data $D_{BRT}$ in accordance with the expressions (56a) and (56b). The voltage data value Y_OUT is calculated as the Y coordinate of the point which is positioned on the $n^{th}$ degree Bezier curve specified by the brightness-corrected control point data CP(k×n)' to CP((k+1)×n)' thus obtained and has an X coordinate equal to the input grayscale value X_IN.

Figure 21:
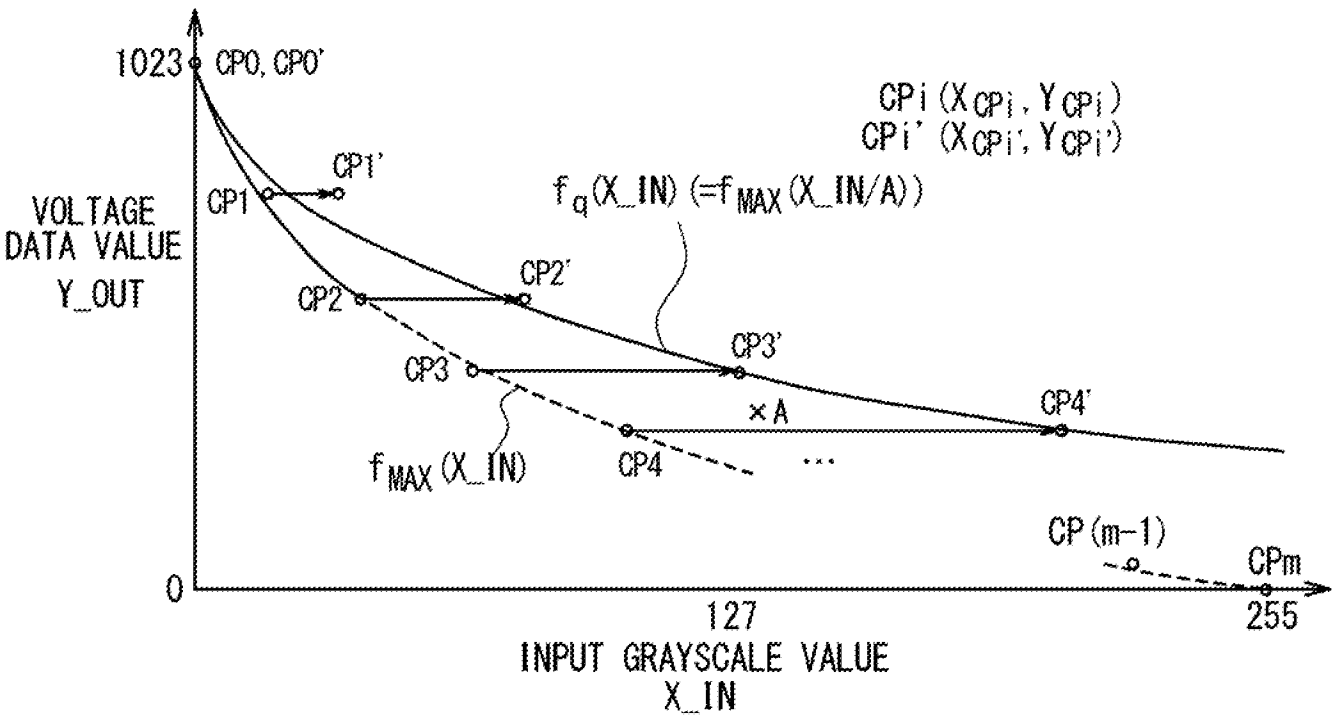
FIG. 21 is a diagram illustrating the relationship between control point data CP0 to CPm and brightness-corrected control point data CP(k×n)' to CP((k+1)×n)'.

FIG. 21 is a diagram illustrating the relationship between the control point data CP0 to CPm and the brightness-corrected control point data CP(k×n)' to CP((k+1)×n)'.

The control points CP0 to CPm are used to specify the correspondence relationship between the input grayscale value X_IN and the voltage data value Y_OUT for the case when the brightness level of the screen is the allowed maximum brightness level, that is, the allowed maximum brightness level is specified by the brightness data $D_{BRT}$. When the brightness level of the screen is the allowed maximum brightness level (that is, the allowed maximum brightness level is specified by the brightness data $D_{BRT}$), the data correction circuit 24A calculates the voltage data value Y_OUT as the Y coordinate of the point which is positioned on the curve specified by the control points CP0 to CPm and has an X coordinate equal to the input grayscale value X_IN. In one embodiment, the data correction circuit 24A calculates the voltage data value Y_OUT corresponding to the input grayscale value X_IN by using the $n^{th}$ degree Bezier curve specified by the control points CP0 to CPm.

When a brightness level other than the allowed maximum brightness level is specified by the brightness data $D_{BRT}$, on the other hand, the data correction circuit 24A calculates the voltage data value Y_OUT with an assumption that the correspondence relationship between the input grayscale value X_IN and the voltage data value Y_OUT for the specified brightness level is represented by the curve obtained by enlarging the curve specified the control points CP0 to CPm to A times in the X axis direction, where A is a coefficient depending on the ratio q of the brightness level specified by the brightness data $D_{BRT}$ to the allowed maximum brightness level and obtained by the following expression (57):

$$A=1/q^{(1/\gamma)}. \tag{57}$$

It should be noted that expression (57) is obtained on the basis of a consideration that the coefficient A should satisfy the following expression (58) when the gamma value of the display device 10 is γ:

$$(X_IN/A)^{\gamma}=q\cdot(X_IN)^{\gamma}. \tag{58}$$

When the gamma value γ is 2.2 and q is 0.5 (that is, the brightness level of the screen is 0.5 times of the allowed maximum brightness level), for example, A is obtained by the following expression (59):

$$A=1/(0.5)^{1/2.2},$$

$$=255/186. \tag{59}$$

The data correction circuit 24A calculates the voltage data value Y_OUT as the Y coordinate of the point which is positioned on the Bezier curve obtained by enlarging the Bezier curve specified by the control points CP0 to CPm by A times in the X axis direction and has an X coordinate equal to the input grayscale value X_IN. In other word, the voltage data value Y_OUT is calculated with an assumption that, when the correspondence relationship between the input grayscale value X_IN and the voltage data value Y_OUT for the case when the brightness level of the screen is the allowed maximum brightness level is represented by the following expression (60a):

$$Y_OUT=f_{MAX}(X_IN), \tag{60a}$$

then the correspondence relationship between the input grayscale value X_IN and the voltage data value Y_OUT for the case when the brightness level of the screen is q times of the allowed maximum brightness level is represented by the following expression (60b):

$$Y_OUT=f_{MAX}(X_IN/A). \tag{60b}$$

The Bezier curve represented as the expression "$Y_OUT=f_{MAX}(X_IN/A)$" can be specified by the control points obtained by multiplying the X coordinates of the control points CP0 to CPm by A. Accordingly, the brightness-corrected control points CP(k×n)' to CP((k+1)×n)', which are obtained by multiplying the X coordinates of the selected control points CP(k×n) to CP((k+1)×n) by A, represent the Bezier curve represented as the expression "$Y_OUT=f_{MAX}(X_IN/A)$". The voltage data value Y_OUT for the case when the brightness level of the screen is q times of the allowed maximum brightness level can be calculated by calculating the voltage data value Y_OUT in accordance with the Bezier curve specified by the brightness-corrected control points CP(k×n)' to CP((k+1)×n)'.

Figure 22:
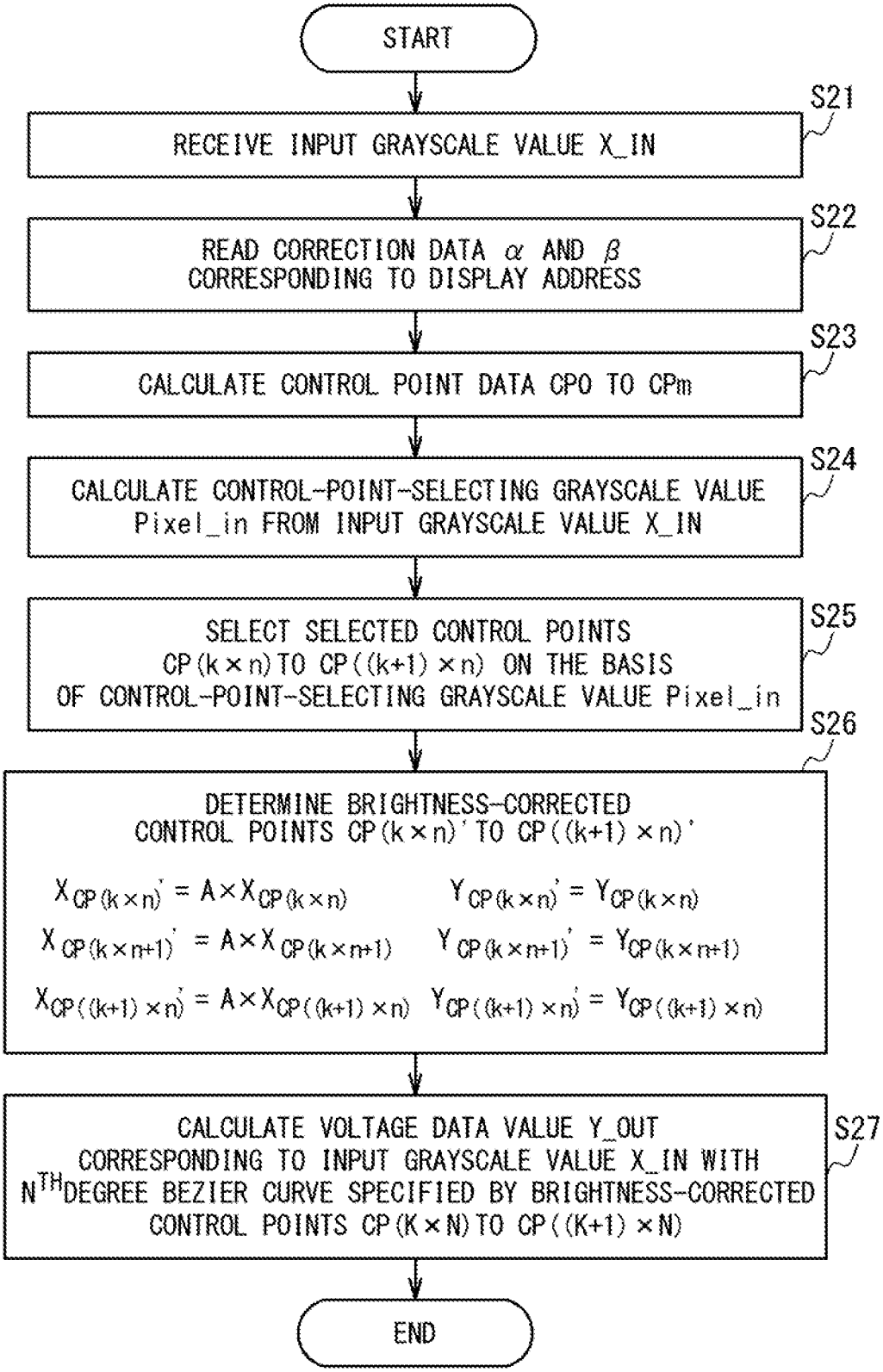
FIG. 22 is a flowchart illustrating the operation of the voltage data generator circuit in the second embodiment.

FIG. 22 is a flowchart illustrating the operation of the voltage data generator circuit 12A illustrated in FIG. 20. When the voltage data value Y_OUT specifying the drive voltage to be supplied to a certain subpixel (that is a certain pixel circuit 6) is calculated, the input grayscale value X_IN associated with the subpixel of interest is supplied to the voltage data generator circuit 12 (step S21).

The display address corresponding to the subpixel of interest is supplied to the correction data memory 22 in synchronization with the supply of the input grayscale value X_IN to the voltage data generator circuit 12A, and the correction data α and β associated with the display address (that is, the correction data α and β associated with the subpixel of interest) are read out (step S22).

The control point data CP0 to CPm actually used for calculating the voltage data value Y_OUT are calculated by correcting the basic control point data CP0_0 to CPm_0 by using the correction data α and β read out from the correction data memory 22 (step S23). The calculation method of the control point data CP0 to CPm are as described in the first embodiment.

In the meantime, the control-point-selecting grayscale value Pixel_IN is calculated from the input grayscale value X_IN by the multiplier circuit 29*a* (step S24). As described above, the control-point-selecting grayscale value Pixel_IN is calculated by multiplying the input grayscale value X_IN by the inverse number 1/A (that is, $q^{(1/\gamma)}$) of the coefficient A.

Furthermore, (n+1) selected control points CP(k×n) to CP((k+1)×n) are selected from the control points CP0 to CPm on the basis of the control-point-selecting grayscale value Pixel_IN (step S25). The selection of the (n+1) selected control points CP(k×n) to CP((k+1)×n) is achieved by the selector 25. It should be noted that the operation of selecting the (n+1) selected control points CP(k×n) to CP((k+1)×n) from the control points CP0 to CPm on the basis of the control-point-selecting grayscale value Pixel_IN, which is obtained by multiplying the input grayscale value X_IN by 1/A, is equivalent to the operation of selecting (n+1) selected control points from among control points obtained by multiplying the X coordinates of the control points CP0 to CPm on the basis of the input grayscale value X_IN.

More specifically, the (n+1) selected control points CP(k×n) to CP((k+1)×n) are selected as follows.

The control points CP0, CPn, CP(2*n*) . . . CP(p×n) of the m (=p×n) control points CP0 to CPm are on the $n^{th}$ degree Bezier curve. Other control points are not necessary on the $n^{th}$ degree Bezier curve, although they determine the shape of the $n^{th}$ degree Bezier curve. The selector 25 compares the control-point-selecting grayscale value Pixel_IN with the X coordinates of the respective control points which are on the $n^{th}$ degree Bezier curve and selects (n+1) control points CP(k×n) to CP((k+1)×n) in response to the result of the comparison.

In detail, when the control-point-selecting grayscale value Pixel_IN is larger than the X coordinate of the control point CP0 and smaller than the X coordinate of the control point CPn, the selector 25 selects the control points CP0 to CPn. When the control-point-selecting grayscale value Pixel_IN is larger than the X coordinate of the control point CPn and smaller than the X coordinate of the control point CP(2*n*), the selector 25 selects the control points CPn to CP(2*n*). Generally, when the control-point-selecting grayscale value Pixel_IN is larger than the X coordinate $X_{CP((k-1)\times n)}$ of the control point CP(k×n) and smaller than the X coordinate $X_{CP(k\times n)}$ of the control point CP((k+1)×n), the selector 25 selects the control points CP(k×n) to CP((k+1)×n), where k is an integer from 0 to p.

When the control-point-selecting grayscale value Pixel_IN is equal to the X coordinate $X_{CP(k\times n)}$ of the control point CP(k×n), in one embodiment, the selector 25 selects the control points CP(k×n) to CP((k+1)×n). In this case, when the control-point-selecting grayscale value Pixel_IN is equal to the control point CP(p×n), the selector 25 selects the control points CP((p−1)×n) to CP(p×n).

Alternatively, the selector 25 may select the control points CP(k×n) to CP((k+1)×n), when the control-point-selecting grayscale value Pixel_IN is equal to the X coordinate $X_{CP((k+1)\times n)}$ of the control point CP((k+1)×n). In this case, when the control-point-selecting grayscale value Pixel_IN is equal to the control point CP0, the selector 25 selects the control points CP0 to CPn.

This is followed by determining brightness-corrected control points CP(k×n)' to CP((k+1)×n)' (step S26). In detail, The X coordinates $X_{CP(k\times n)}'$ to $X_{CP((k+1)\times n)}'$ of the brightness-corrected control points CP(k×n)' to CP((k+1)×n)' are calculated as the products of the coefficient A and the X coordinates $X_{CP(k\times n)}$ to $X_{CP((k+1)\times n)}$ of the selected control points CP(k×n) to CP((k+1)×n) by the multiplier circuit 29*b*. In other words, the multiplier circuit 29*b* calculates the X coordinates $X_{CP(k\times n)}'$ to $X_{CP((k+1)\times n)}'$ of the brightness-corrected control points CP(k×n)' to CP((k+1)×n)' in accordance with the following expression (61a):

$$X'_{CP(k\times n)} = A \cdot X_{CP(k\times n)} \tag{61a}$$
$$X'_{CP((k\times n)+1)} = A \cdot X_{CP((k\times n)+1)}$$
$$\ldots$$
$$X'_{CP((k+1)\times n)} = A \cdot X_{CP((k+1)\times n)}.$$

The Y coordinates $Y_{CP(k\times n)}'$ to $Y_{CP((k+1)\times n)}'$ of the brightness-corrected control points CP(k×n)' to CP((k+1)×n)' are determined as being equal to the Y coordinates $Y_{CP(k\times n)}$ to $Y_{CP((k+1)\times n)}$ of the selected control points CP(k×n) to CP((k+1)×n). In other words, the Y coordinates $Y_{CP(k\times n)}'$ to $Y_{CP((k+1)\times n)}'$ of the brightness-corrected control points CP(k×n)' to CP((k+1)×n)' are represented by the following expression (61b):

$$Y'_{CP(k\times n)} = Y_{CP(k\times n)}, \tag{61b}$$
$$Y'_{CP((k\times n)+1)} = Y_{CP((k\times n)+1)},$$
$$\ldots$$
$$Y'_{CP((k+1)\times n)} = Y_{CP((k+1)\times n)}.$$

The X and Y coordinates of the brightness-corrected control points CP(k×n)' to CP((k+1)×n)' thus determined are supplied to the Bezier calculation circuit 26 and the voltage data value Y_OUT corresponding to the input grayscale value X_IN is calculated by the Bezier calculation circuit 26 (step S27). The voltage data value Y_OUT is calculated as the Y coordinate of the point which is positioned on the $n^{th}$ degree Bezier curve specified by the (n+1) brightness-corrected control points CP(k×n)' to CP((k+1)×n)' and has an X coordinate equal to the input grayscale value X_IN. The calculation performed in the Bezier calculation circuit 26 is the same as that performed in the first embodiment except for that the brightness-corrected control points CP(k×n)' to CP((k+1)×n)' are used in place of the selected control points CP(k×n) to CP((k+1)×n).

The display device 10A of the present embodiment is configured to calculate the brightness-corrected control points CP(k×n)' to CP((k+1)×n)' from the selected control points CP(k×n) to CP((k+1)×n) in response to the brightness data $D_{BRT}$ and this allows calculating the voltage data $D_{VOUT}$ (that is, the voltage data value Y_OUT) which achieves a desired brightness level of the screen.

Although embodiments of the present invention have been specifically described in the above, the present invention is not limited to the above-described embodiment. It would be understood by a person skilled in the art that the present invention may be implemented with various modifications.

What is claimed is:

1. A display driver for driving a display panel including a plurality of pixel circuits, the display driver comprising:

a voltage data generator circuit configured to calculate a voltage data value from an input grayscale value with respect to a first pixel circuit of the plurality of pixel circuits by:

selecting at least three control points, wherein each of the at least three control points specifies a relationship between the input grayscale value and the voltage data value and is generated by correcting a first coordinate of each of a plurality of basic control points based on a respective one of a first plurality of correction values and a second coordinate of each of the plurality of basic control points based on a respective one of a second plurality of correction values, wherein the first coordinate of each of the plurality of basic control points and the second coordinate of each of the plurality of basic control points are corrected independently from each other, wherein a first one of the first plurality of correction values differs from a second one of the first plurality of correction values, and wherein each of the plurality of basic control points specifies a basic relationship between the input grayscale value and the voltage data value; and determining at least one midpoint of the at least three control points; and driver circuitry configured to drive the display panel based at least in part on the voltage data value.

2. The display driver according to claim 1, wherein the first coordinate and the second coordinate of each of the plurality of basic control points are along a first coordinate axis and a second coordinate axis of a coordinate system, respectively, and wherein the first coordinate axis is associated with the input grayscale value and the second coordinate axis is associated with the voltage data value.

3. The display driver according to claim 2, wherein the voltage data generator circuit is further configured to calculate third and fourth coordinates of each of the at least three control points independently from each other based on the first and second coordinates of each of the plurality of basic control points, the first plurality of correction values, and the second plurality of correction values.

4. The display driver according to claim 3, wherein the third coordinate of each of the at least three control points associated with the first pixel circuit is calculated based at least in part on a product of the first coordinate of the respective one of the plurality of basic control points and a first correction value of the first plurality of correction values, and wherein the fourth coordinate of each of the at least three control points associated with the first pixel circuit is calculated based at least in part on a sum of the second coordinate of the respective one of the plurality of basic control points and a second correction value of the second plurality of correction values.

5. The display driver according to claim 4, the first correction value is calculated from first correction data for each of the at least three control points associated with the first pixel circuit and the second correction value is calculated from second correction data for each of the at least three control points associated with the first pixel circuit.

6. The display driver according to claim 4, wherein each of the plurality of pixel circuits includes an organic light emitting diode (OLED) element, and wherein the first correction value is determined so as to compensate for variations in a current-voltage property of the OLED element.

7. The display driver according to claim 4, wherein each of the plurality of pixel circuits includes an organic light emitting diode (OLED) element and a drive transistor configured to drive the OLED element, and wherein the second correction value is determined so as to compensate for variations in a threshold voltage of the drive transistor.

8. The display driver according to claim 3, wherein each of the plurality of pixel circuits includes an organic light emitting diode (OLED) element, wherein the voltage data generator circuit is further configured to:

determine brightness-corrected control points based on the input grayscale value, control point data, and brightness data, wherein the brightness data specifies a brightness level of a screen displayed on the display panel, and the brightness-corrected control points specify a correspondence relationship between the input grayscale value and the voltage data value for the brightness level of the screen specified by the brightness data; and calculate the voltage data value from the input grayscale value in accordance with the correspondence relationship specified by the brightness-corrected control points, wherein fifth coordinates specifying positions of the brightness-corrected control points along the first coordinate axis are calculated based on the third coordinates of the at least three control points and the brightness data, and wherein sixth coordinates specifying positions of the brightness-corrected control points along the second coordinate axis are determined based on the fourth coordinates of the at least three control points.

9. A display device, comprising:

a display panel including a plurality of pixel circuits; and a display driver configured to drive the display panel, wherein the display driver includes:

a voltage data generator circuit configured to calculate a voltage data value from an input grayscale value for a first pixel circuit of the plurality of pixel circuits by:

selecting at least three control points, wherein each of the at least three the control points specifies a correspondence relationship between the input grayscale value and the voltage data value and is generated by correcting a first coordinate of each of a plurality of basic control points based on a respective one of a first plurality of correction values and a second coordinate of each of the plurality of basic control points based on a respective one of a second plurality of correction values, wherein the first coordinate of each of the plurality of basic control points and the second coordinate of each of the plurality of basic control points are corrected independently from each other, wherein a first one of the first plurality of correction values differs from a second one of the first plurality of correction values, and wherein each of the plurality of basic control points specifies a basic correspondence relationship between the input grayscale value and the voltage data value; and determining at least one midpoint of the at least three control points; and driver circuitry configured to drive the display panel based at least in part on the voltage data value.

10. The display device according to claim 9, wherein the first coordinate and the second coordinate of each of the plurality of basic control points are along a first coordinate axis and a second coordinate axis of a coordinate system, respectively, and wherein the first coordinate axis is associated with a grayscale value and the second coordinate axis is associated with the voltage data value.

11. The display device of claim 10, wherein the voltage data generator circuit is further configured to calculate third and fourth coordinates of each of the at least three control points independently from each other based on the first and second coordinates of each of the plurality of basic control points, the first plurality of correction values, and the second plurality of correction values.

12. The display device according to claim 11, wherein the third coordinate of each of the at least three control points associated with the first pixel circuit is calculated based at least in part on a product of the first coordinate of the respective one of the plurality of basic control points and a first correction value of the first plurality of correction values, and wherein the fourth coordinate of each of the at least three control points associated with the first pixel circuit is calculated based at least in part on a sum of the second coordinate of the respective one of the plurality of basic control points and a second correction value of the second plurality of correction values.

13. The display device according to claim 12, wherein the first correction value is calculated from first correction data for each of the at least three control points associated with the first pixel circuit and the second correction value is calculated from second correction data for each of the at least three control points associated with the first pixel circuit.

14. The display device according to claim 12, wherein each of the plurality of pixel circuits includes an organic light emitting diode (OLED) element, and wherein the first correction value is determined so as to compensate for variations in a current-voltage property of the OLED element.

15. The display device according to claim 12, wherein each of the plurality of pixel circuits includes an organic light emitting diode (OLED) element and a drive transistor configured to drive the OLED element, and wherein the second correction value is determined so as to compensate for variations in a threshold voltage of the drive transistor.

16. The display device according to claim 11, wherein each of the plurality of pixel circuits includes an organic light emitting diode (OLED) element, wherein the voltage data generator circuit is further configured to determine brightness-corrected control points based on the input grayscale value, control point data, and brightness data, wherein the brightness data specify a brightness level of a screen displayed on the display panel, and the brightness-corrected control points comprise a correspondence relationship between the input grayscale value and the voltage data value for the brightness level of the screen specified by the brightness data; and calculate the voltage data value from the input grayscale value in accordance with the correspondence relationship comprised by the brightness-corrected control points, wherein fifth coordinates specifying positions of the brightness-corrected control points along the first coordinate axis are calculated based on the third coordinates of the at least three control points and the brightness data, and wherein sixth coordinates specifying positions of the brightness-corrected control points along the second coordinate axis are determined based on the fourth coordinates at least three of the control points.

17. A drive method for driving a display panel including a plurality of pixel circuits, the method comprising:

calculating a voltage data value from an input grayscale value with respect to a first pixel circuit of the plurality of pixel circuits, wherein the calculating the voltage data value includes:

preparing basic control point data which specify a basic relationship between the input grayscale value and the voltage data value;

preparing correction data for each of the plurality of pixel circuits, the correction data comprising a first plurality of correction values and a second plurality of correction values;

generating control point data associated with the first pixel circuit by:

correcting a first coordinate of each of a plurality of basic control points of the basic control point data based on a respective one of the first plurality of correction values and a second coordinate of each of the plurality of basic control points based on respective one of the second plurality of corrections values, wherein the first coordinate of each of the plurality of basic control points and the second coordinate of each of the plurality of basic control points are corrected independently from each other, and wherein a first one of the first plurality of correction values differs from a second one of the first plurality of correction values;

selecting at least three control points of the control point data; and determining at least one midpoint of the at least three control points, wherein the control point data specify a relationship between the input grayscale value and the voltage data value; and calculating the voltage data value from the input grayscale value based on a relationship between the input grayscale value and the voltage data value at least partially based on the at least one midpoint of the at least three control points; and driving the display panel based at least part on the voltage data value.

18. The method of claim 17, wherein the first coordinate and the second coordinate of each of the plurality of basic control points are along a first coordinate axis and a second coordinate axis of a coordinate system, respectively, and wherein the first coordinate axis is associated with the input grayscale value and the second coordinate axis is associated with the voltage data value.

19. The method of claim 18, further comprising calculating third and fourth coordinates of each of the at least three control points independently from each other based on the first and second coordinates of each of the plurality of basic control points, the first plurality of correction values, and the second plurality of correction values.

20. The method of claim 19, wherein the third coordinate of each of the at least three control points associated with the first pixel circuit is calculated based on a product of the first coordinate of the respective one of the plurality of basic control points and a first correction value of the first plurality of correction values, and wherein the fourth coordinate of each of the at least three control points associated with the first pixel circuit is calculated based on a sum of the second coordinate of the respective one of the plurality of basic control points and a second correction value of the second plurality of correction values.

* * * * *